US012397978B2

(12) United States Patent
Iwahara et al.

(10) Patent No.: US 12,397,978 B2
(45) Date of Patent: Aug. 26, 2025

(54) CABLE TIE

(71) Applicants: DAIWA KASEI KOGYO KABUSHIKI KAISHA, Okazaki (JP); TOYOTA JIDOSHA KABUSHIKI KAISHA, Toyota (JP)

(72) Inventors: Toshio Iwahara, Okazaki (JP); Katsuya Hirakawa, Okazaki (JP); Satoshi Tsurumi, Okazaki (JP); Makoto Kato, Okazaki (JP); Itsuo Wakabayashi, Toyota (JP); Atsushi Takenaka, Toyota (JP)

(73) Assignees: DAIWA KASEI KOGYO KABUSHIKI KAISHA, Okazaki (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/358,317

(22) Filed: Jul. 25, 2023

(65) Prior Publication Data

US 2024/0034530 A1 Feb. 1, 2024

(30) Foreign Application Priority Data

Jul. 28, 2022 (JP) ..... 2022-120460

(51) Int. Cl.
*B65D 63/10* (2006.01)

(52) U.S. Cl.
CPC .... *B65D 63/1027* (2013.01); *B65D 2563/103* (2013.01)

(58) Field of Classification Search
CPC ..... B65D 63/1027; B65D 2563/103; B65D 63/1072; B65B 13/18; B65B 13/06; B65B 13/24
See application file for complete search history.

(56) References Cited

U.S. PATENT DOCUMENTS 3,339,246 A * 9/1967 Geisinger ..... B65D 63/1063 24/16 PB
3,339,247 A * 9/1967 Geisinger ..... B65D 63/1027 24/16 PB
3,837,047 A * 9/1974 Bunnell ..... B65D 63/1072 24/16 PB
4,447,934 A * 5/1984 Anscher ..... H02G 3/30 248/74.3
4,991,265 A * 2/1991 Campbell ..... B65D 63/1027 24/129 R
5,832,567 A * 11/1998 Edwards ..... G09F 3/037 24/30.5 P (Continued)

FOREIGN PATENT DOCUMENTS

JP 2001-208017 A 8/2001

*Primary Examiner* — David M Upchurch
(74) *Attorney, Agent, or Firm* — Christensen, Fonder, Dardi & Herbert PLLC; John P. Fonder

(57) ABSTRACT

A cable tie may include a desired length of belt, and a buckle connected to a proximal end portion of the belt. The buckle has a belt insertion hole and a slot continuous with the belt insertion hole. The belt insertion hole is configured such that the belt is longitudinally introduced thereinto. The slot is configured such that the belt is laterally introduced into the belt insertion hole therethrough. The slot includes an inlet opening that is gradually widened outward.

8 Claims, 21 Drawing Sheets

(56) References Cited

U.S. PATENT DOCUMENTS

| | | | | | |
|---|---|---|---|---|---|
| 5,839,169 | A * | 11/1998 | Edwards | G09F 3/037 | 24/17 AP |
| 5,901,416 | A * | 5/1999 | Mears | B65D 63/1063 | 24/17 AP |
| 6,594,867 | B1 * | 7/2003 | Pettersson | B65D 63/1027 | 24/30.5 P |
| 10,954,047 | B1 * | 3/2021 | Cogliandro | B65D 63/1081 | |
| 11,191,254 | B2 * | 12/2021 | Davis | A01K 27/001 | |
| 11,338,973 | B2 * | 5/2022 | Yamane | B65D 63/1063 | |
| 2005/0204515 | A1 * | 9/2005 | Hewes | B65D 63/1063 | 24/16 PB |
| 2008/0028576 | A1 * | 2/2008 | Okamoto | B65D 63/1027 | 24/16 R |
| 2018/0080580 | A1 * | 3/2018 | Coulter | F16L 3/2336 | |
| 2019/0009958 | A1 * | 1/2019 | Wiles | B65D 63/1072 | |

* cited by examiner

CABLE TIE

CROSS-REFERENCE TO RELATED APPLICATIONS

This application claims priority to Japanese Patent Application serial number 2022-120460 filed Jul. 28, 2022, the contents of which are incorporated herein by reference.

BACKGROUND

The present disclosure relates to a cable tie (a clamping band). More particularly, the present disclosure relates to a cable tie for tying together a bundle of tied articles (e.g., a wiring harness that is used for vehicle wiring).

Generally, a cable tie for tying together a bundle of tied articles (e.g., a wiring harness) includes a desired length of flexible belt that is configured to be wound or wrapped around the bundle of tied articles, and a buckle connected to a proximal end of the belt. In order to tie together the bundle of tied articles, the belt is wound or wrapped around the bundle of tied articles and is then inserted into a belt insertion hole formed in the buckle. Thereafter, the belt is fastened and is then locked by engaging an engagement strip formed in the belt insertion hole of the buckle. Thus, the bundle of tied articles is tied together by the cable tie.

A known cable tie is taught by, for example, Japanese Laid-Open Patent Publication No. 2001-208017. The known cable tie includes an open-ended box-shaped buckle and a belt. The buckle includes a belt insertion hole longitudinally formed therethrough and having an inlet end. The belt insertion hole is configured such that the belt is longitudinally introduced thereinto through the inlet end. Further, the buckle includes a slot longitudinally formed therein. The slot extends along the entire length of the buckle so as to be continuous with the belt insertion hole over the entire length thereof. The longitudinal slot thus formed allows the belt to be laterally introduced into the belt insertion hole as necessary. Therefore, the belt can be introduced into the belt insertion hole not only through the inlet end of the belt insertion hole but also through the slot formed in the buckle.

According to the known cable tie thus constructed, the belt can be effectively introduced into the belt insertion hole because the belt can be laterally introduced into the belt insertion hole through the longitudinal slot formed in the buckle. However, the known cable tie has room for improvement in structure or shape of the buckle.

Thus, there is a need in the art for improved cable ties.

SUMMARY

For example, in one aspect of the present disclosure, a cable tie may include a desired length of belt, and a buckle connected to a proximal end portion of the belt. The buckle has a belt insertion hole and a slot continuous with the belt insertion hole. The belt insertion hole is configured such that the belt is longitudinally introduced thereinto. The slot is configured such that the belt is laterally introduced into the belt insertion hole therethrough. The slot includes an inlet opening that is gradually widened outward.

According to this aspect, the slot formed in the buckle includes the inlet opening that is gradually widened outward. Therefore, the belt can be easily introduced into the slot with the aid of such an inlet opening. As a result, the belt can be easily and smoothly introduced into the belt insertion hole of the buckle through the slot.

Additional objects, features and advantages of the present disclosure will be readily understood after reading the following detailed description together with the accompanying drawings and the claims.

DETAILED DESCRIPTION

Detailed representative embodiments of the present disclosure are shown in FIGS. 1 to 25.

A first detailed representative embodiment of the present disclosure will be described with reference to FIGS. 1 to 9. The first embodiment may be directed to a cable tie 1 for tying together a bundle of tied articles. Further, in this embodiment, a wiring harness 10 that is used for vehicle wiring may be shown as an example of the bundle of tied article. Further, a longitudinal or front-back direction (forward and backward directions), a lateral direction (rightward and leftward directions) and a vertical direction (upward and downward directions) described therein are determined only for the purpose of convenience and not intended to limit the disclosure.

Figure 1:
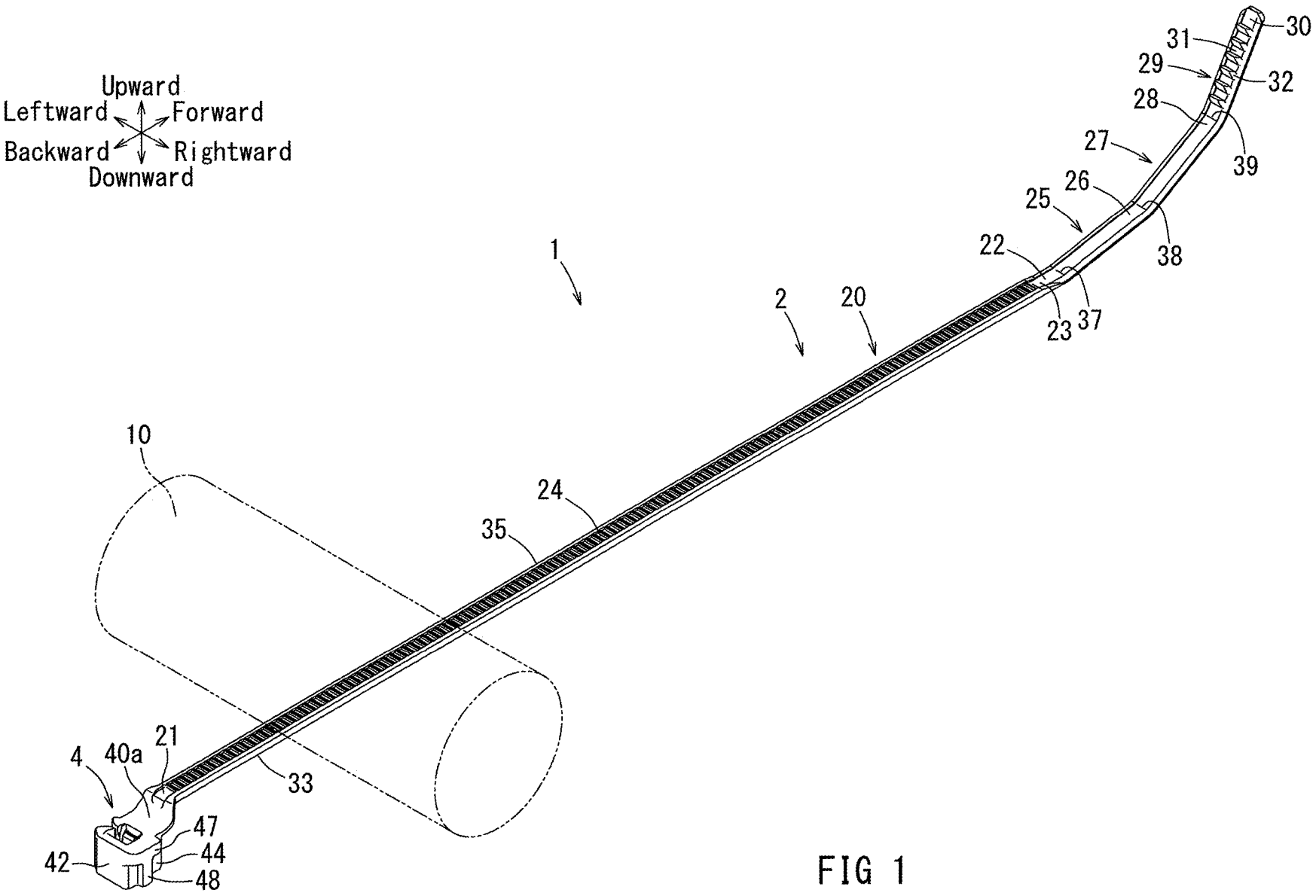
FIG. 1 is an overall perspective view of a cable tie according to a first representative embodiment of the present disclosure, which is viewed from above.
Figure 2:
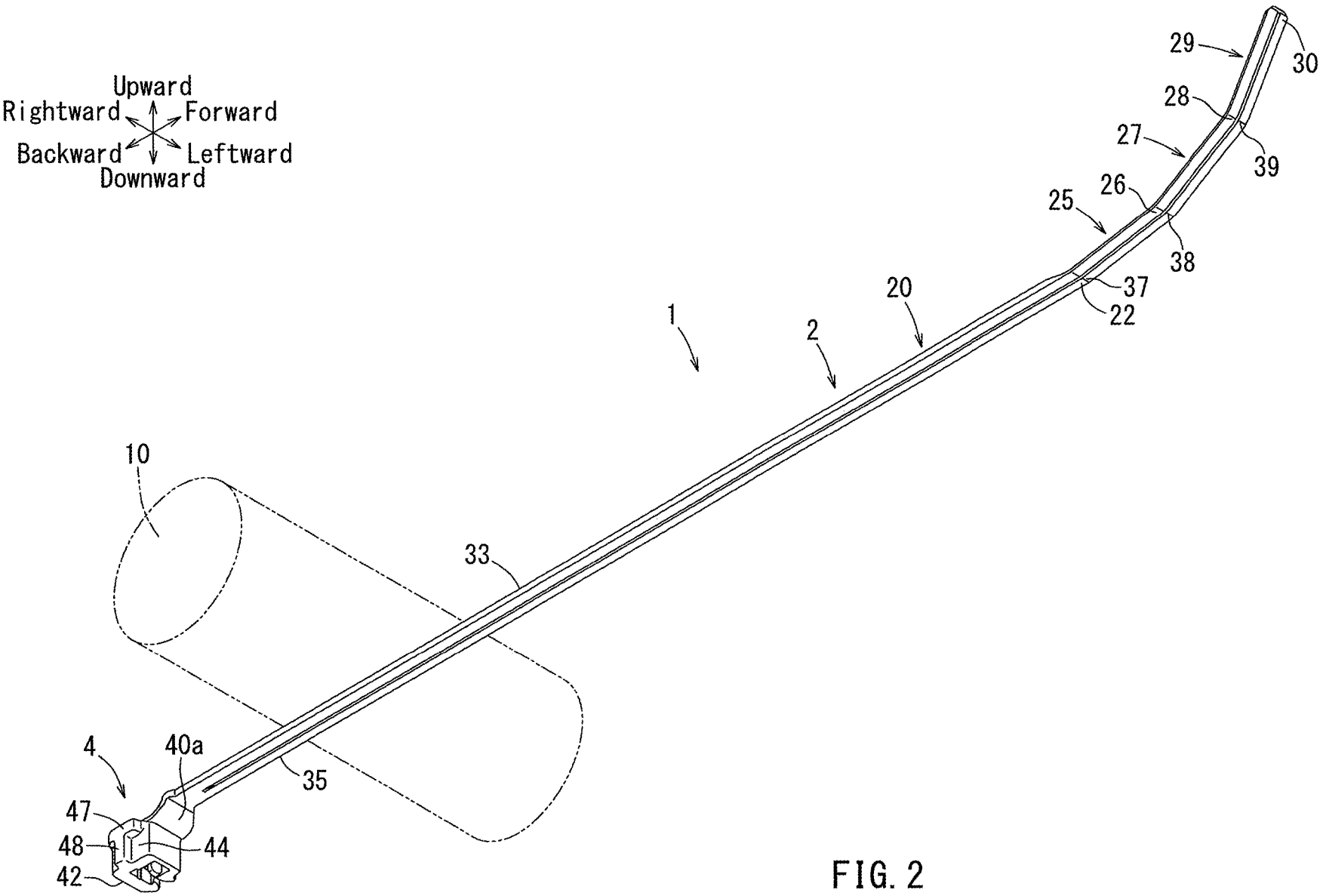
FIG. 2 is an overall perspective view of the cable tie, which is viewed from the bottom.
Figure 4:
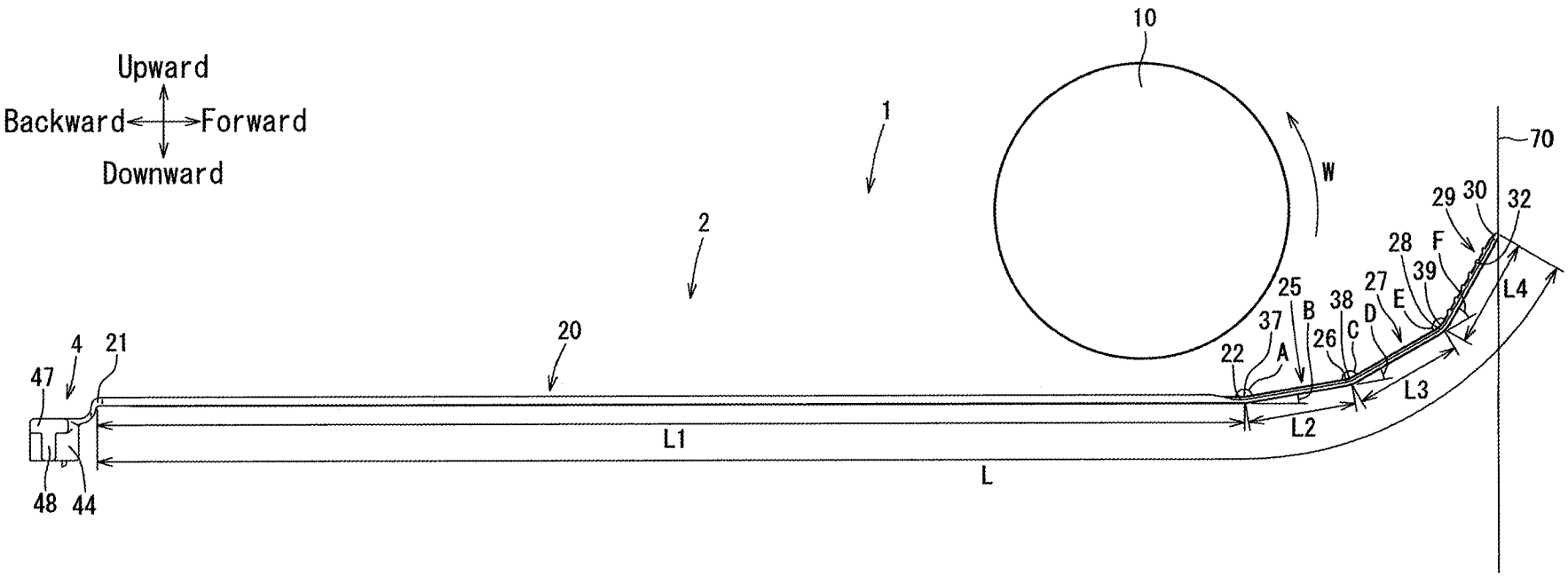
FIG. 4 is a side view of the cable tie, which is viewed from the right.

As shown in FIGS. 1, 2 and 4, the cable tie 1 may be integrally formed as a unit by integral molding of a rigid synthetic resin. The cable tie 1 may include a desired length of flexible belt 2 and a buckle 4. The belt 2 may have a substantially constant width over the entire length thereof and may be configured to be wrapped around the wiring harness 10. The belt 2 may have a base portion 20 and a functional portion (not labeled). The base portion 20 of the belt 2 may be connected to the buckle 4 (which will be hereinafter described) at a proximal end 21 thereof. The base portion 20 may substantially horizontally linearly extend forward from the buckle 4. Further, the proximal end 21 of the base portion 20 may be referred to as a proximal end portion of the belt 2.

As shown in FIGS. 1, 2 and 4, the functional portion of the belt 2 may include a first linear portion 25, a second linear portion 27 and a third linear portion 29. The first linear portion 25 may be connected to a distal end 22 of the base portion 20 at a proximal end (not labeled) thereof. Further, as shown in FIG. 4, the first linear portion 25 may be inclined at an (first) angle B with respect to the base portion 20 in a direction which the belt 2 is wrapped around the wiring harness 10. Further, such a direction may be hereinafter referred to as a belt wrapping direction W. In other words, the first linear portion 25 may be inclined with respect to the base portion 20 in the belt wrapping direction W so as to form an angle A (which may be referred to as a supplementary angle of the angle B) therebetween. Thus, the first liner portion 25 may be inwardly obliquely connected to the base portion 20 via a bent portion 37.

As shown in FIGS. 1, 2 and 4, the second linear portion 27 may be connected to a distal end 26 of the first liner portion 25 at a proximal end (not labeled) thereof. Further, as shown in FIG. 4, the second linear portion 27 may be inclined at an (second) angle D with respect to the first liner portion 25 in the belt wrapping direction W. In other words, the second linear portion 27 may be inclined with respect to the first linear portion 25 in the belt wrapping direction W so as to form an angle C (which may be referred to as a supplementary angle of the angle D) therebetween. Thus, the second liner portion 27 may be inwardly obliquely connected to the first linear portion 25 via a bent portion 38.

As shown in FIGS. 1, 2 and 4, the third linear portion 29 may be connected to a distal end 28 of the second liner portion 27 at a proximal end (not labeled) thereof. Further, as shown in FIG. 4, the third linear portion 29 may be inclined at an (third) angle F with respect to the second liner portion 27 in the belt wrapping direction W. In other words, the third linear portion 29 may be inclined with respect to the second linear portion 27 in the belt wrapping direction W so as to form an angle E (which may be referred to as a supplementary angle of the angle F) therebetween. Thus, the third liner portion 29 may be inwardly obliquely connected to the second linear portion 27 via a bent portion 39.

The first angle B, the second angle D and the third angle F may be determined to meet the following requirements:

1) the first angle B≤the second angle D≤the third angle F
2) the first angle B+the second angle D+the third angle F≤90 degrees.

Further, in this embodiment, the first angle B, the second angle D and the third angle F are respectively determined to 10 degrees, 20 degrees and 30 degrees.

Figure 3:
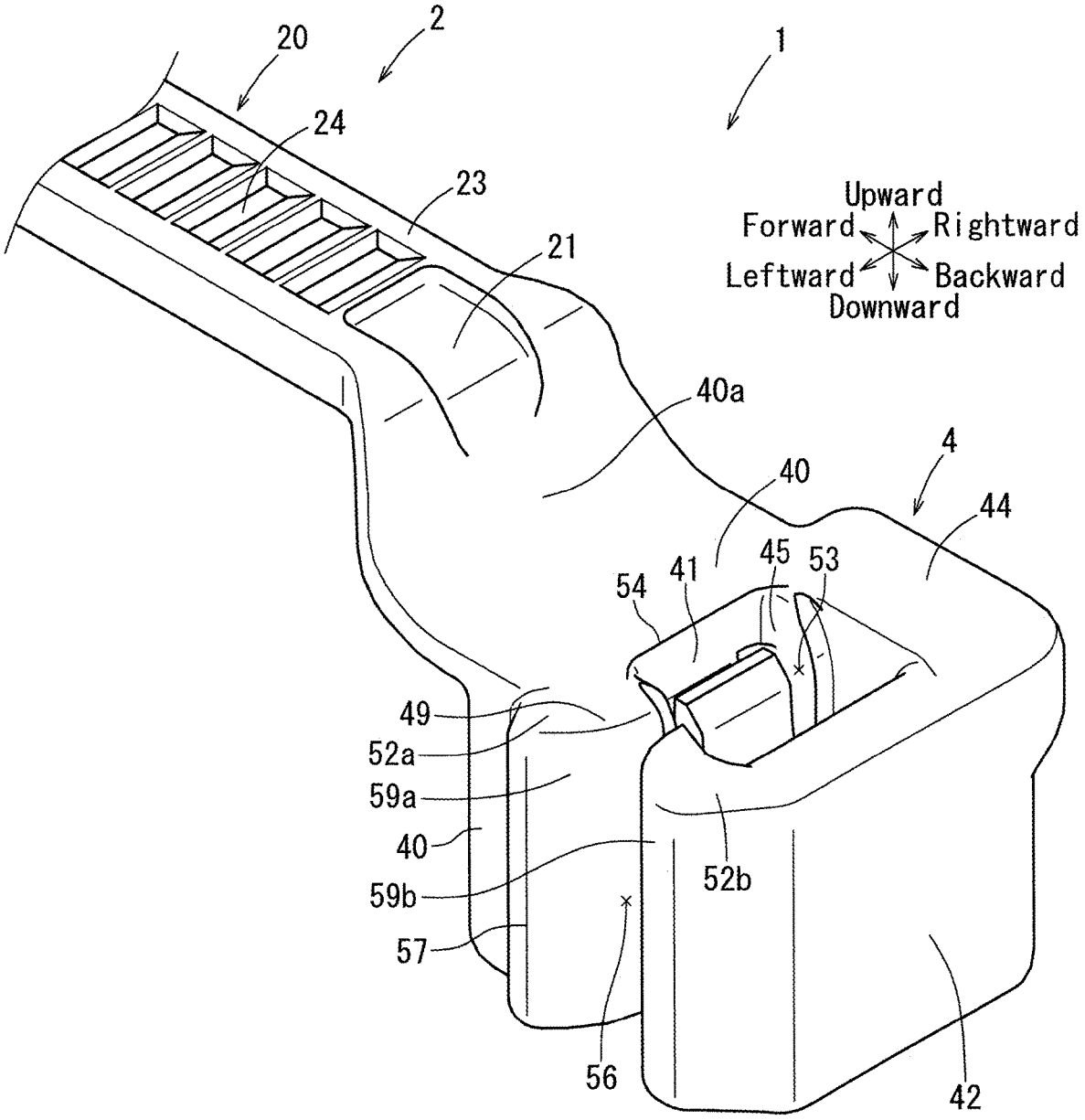
FIG. 3 is an enlarged perspective view of a buckle of the cable tie, which is viewed from above.
Figure 9:
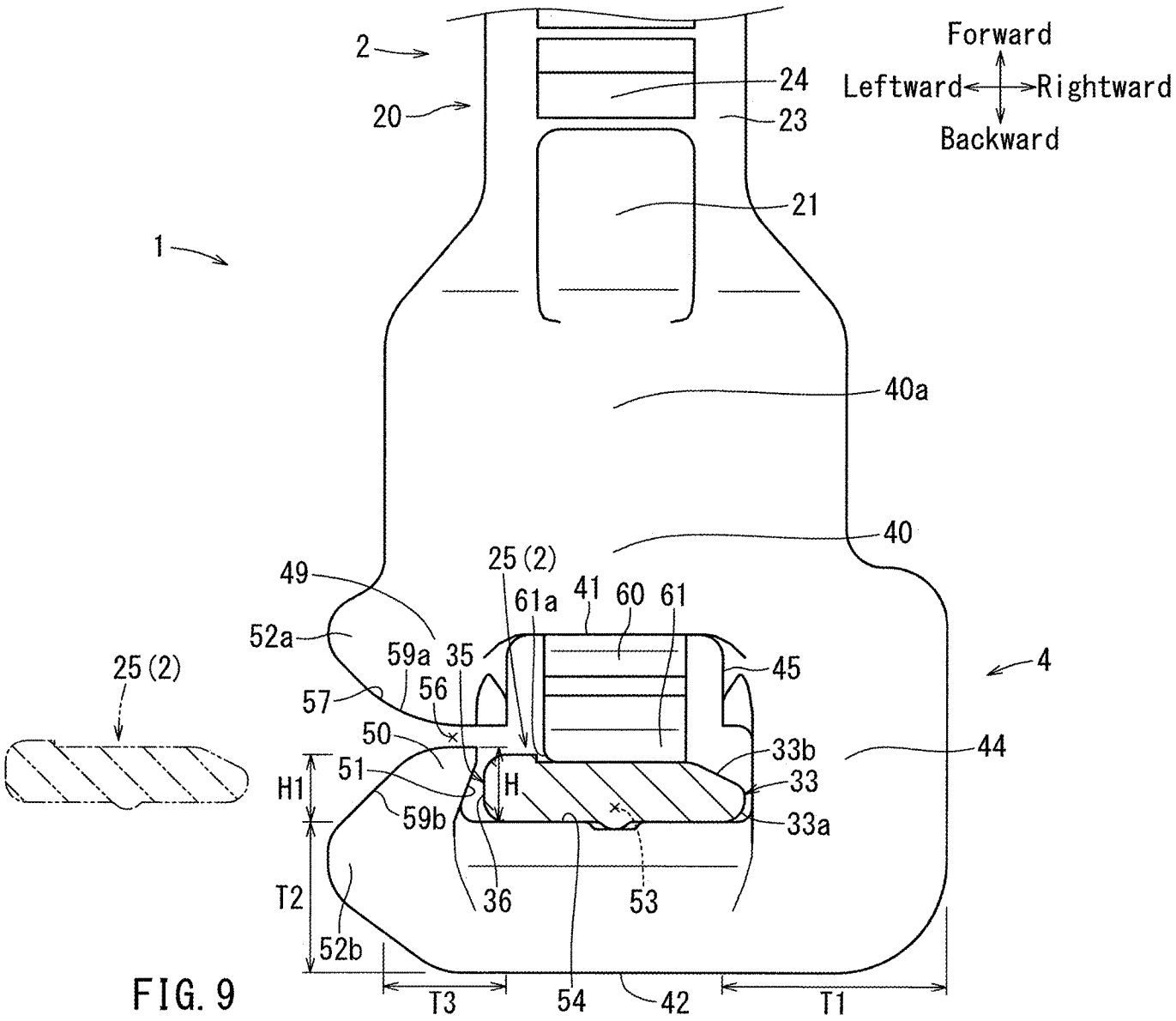
FIG. 9 is an enlarged partially cross-sectional plan view of the buckle into which a belt of the cable tie is introduced, which illustrates the process of tying together the bundle of tied articles using the cable tie.

As shown in FIGS. 1 and 3, the base portion 20 of the belt 2 may have a plurality of engagement teeth or rack teeth 24 that are formed in an inner surface 23 thereof. The rack teeth 24 may preferably be arranged at a constant pitch distance in a longitudinal direction of the base portion 20. Further, the first linear portion 25 of the functional portion of the belt 2 may be specially shaped in cross section. That is, a right (first) side edge 33 of the first linear portion 25 may have a special shape different from a left (second) side edge 35 of the first linear portion 25. In particular, the right side edge 33 of the first linear portion 25 may have a lower rounded surface 33*a* and an upper slanted surface 33*b* (FIG. 9). Thus, the right side edge 33 of the first linear portion 25 may be formed into a wedged or tapered shape as a whole. Conversely, the left side edge 35 of the first linear portion 25 may be simply chamfered so as to have a sheer or perpendicular end surface 36. Further, the second linear portion 27 and the third linear portion 29 of the functional portion of the belt 2 may preferably be formed such that their right side edges (not labeled) respectively have a wedged or tapered shape. Similarly, the base portion 20 of the belt 2 may be formed such that its right side edges (not labeled) has a wedged or tapered shape as necessary. Further, the right side edge 33 and the left side edge 35 of the first liner portion 25 may be referred to as the right side edges 33 and the left side edge 35 of the belt 2 in some situation.

As shown in FIG. 1, the third linear portion 29 of the belt 2 may have a plurality of gear tooth-shaped projections 32 that are formed in a central portion of an inner surface 31 thereof. The projections 32 may preferably be arranged at a constant pitch distance in a longitudinal direction of the third linear portion 29.

As shown in FIG. 4, in this embodiment, a length L2 of the first linear portion 25, a length L3 of the second linear portion 27 and a length L4 of the third linear portion 29 may be determined to be equal to each other. Further, a length of the functional portion of the belt 2 (i.e., a sum of the length L2 of the first linear portion 25, the length L3 of the second linear portion 27 and the length L4 of the third linear portion 29, or a difference between an overall length L of the belt 2 and a length L1 of the base portion 20 of the belt 2) may be determined to be equal to 28±10 percent of the overall length L of the belt 2.

Figure 5:
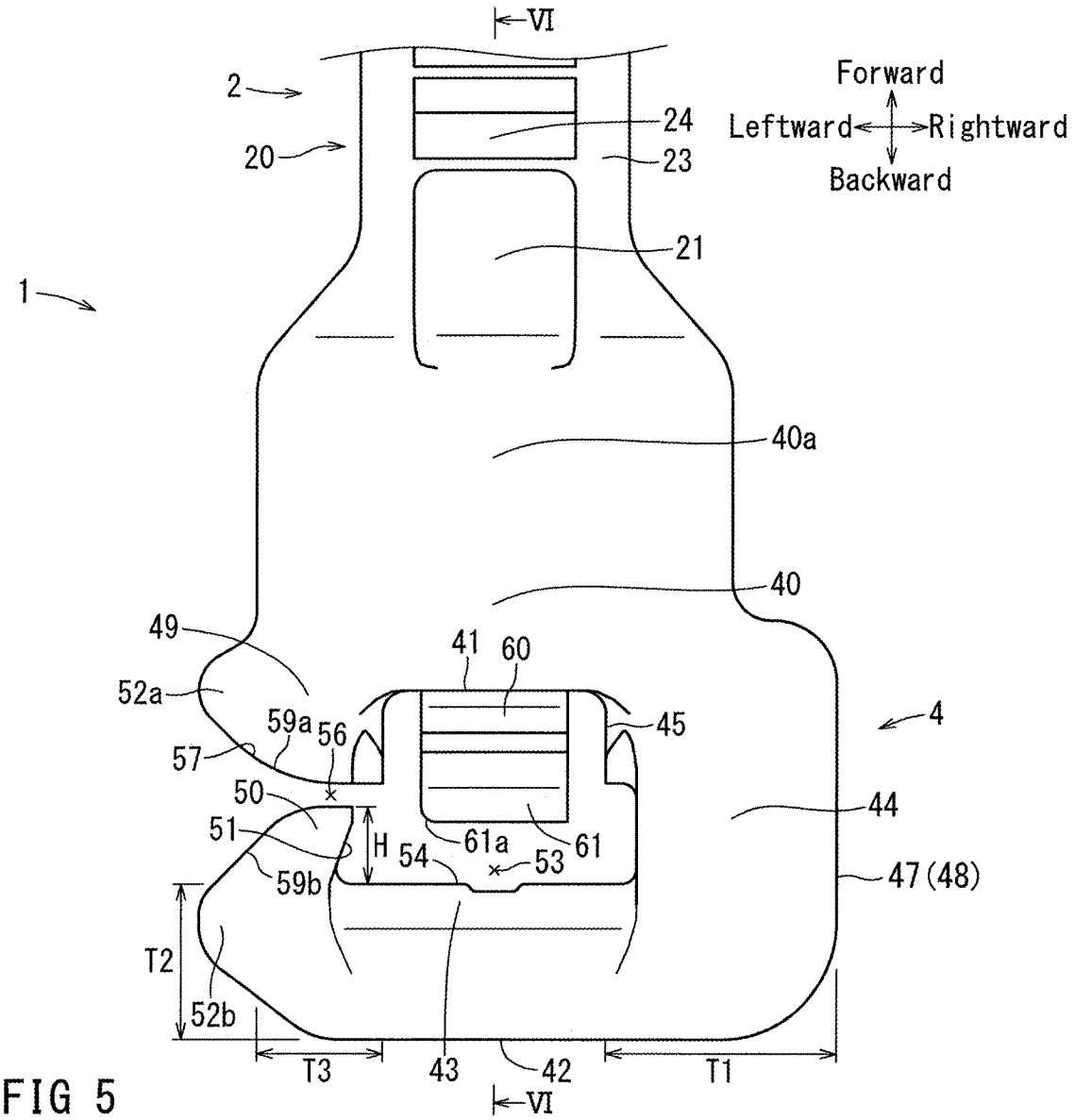
FIG. 5 is a plan view of FIG. 3.
Figure 6:
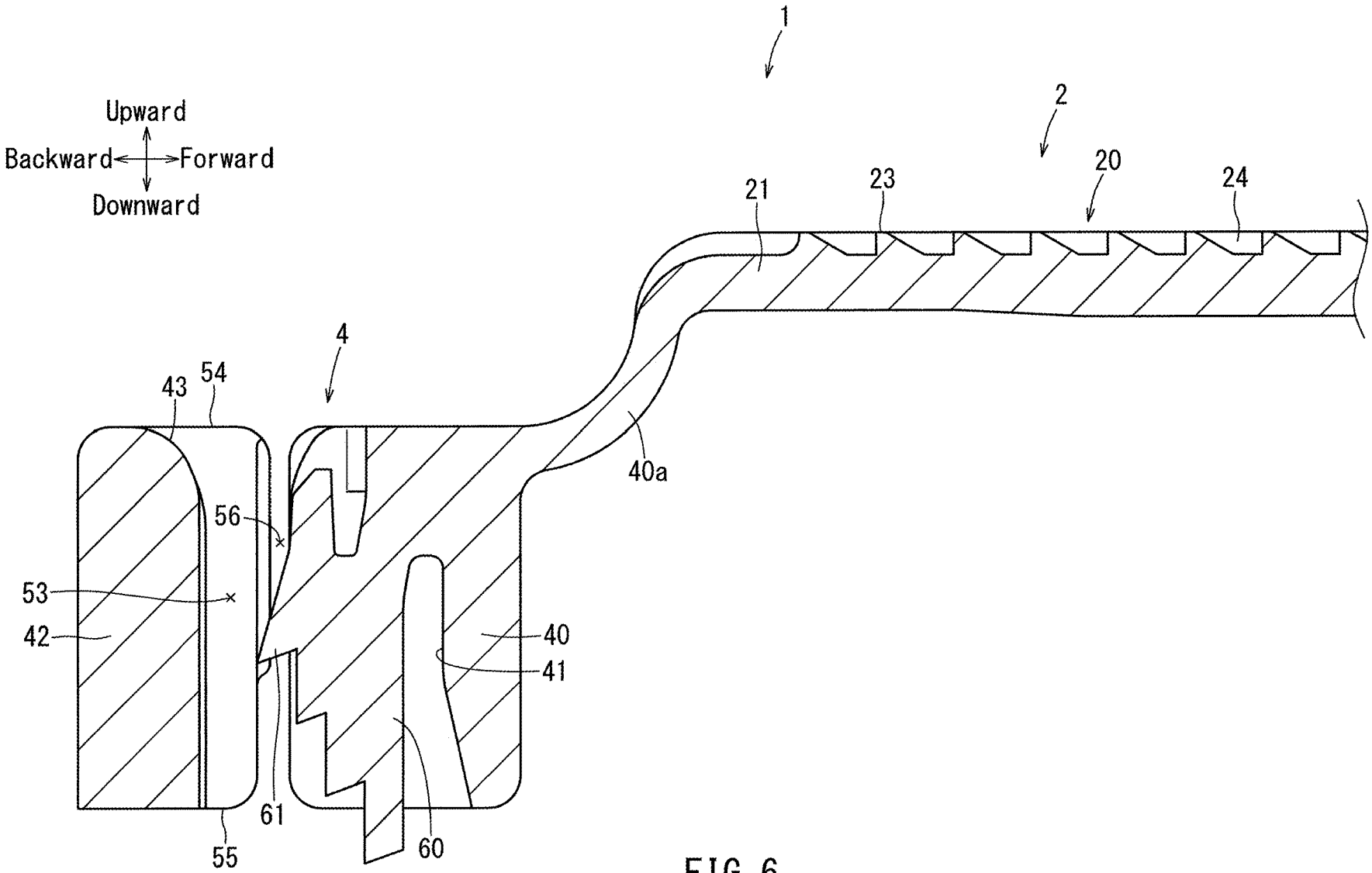
FIG. 6 is a cross-sectional view taken along line VI-VI in FIG. 5.
Figure 7:
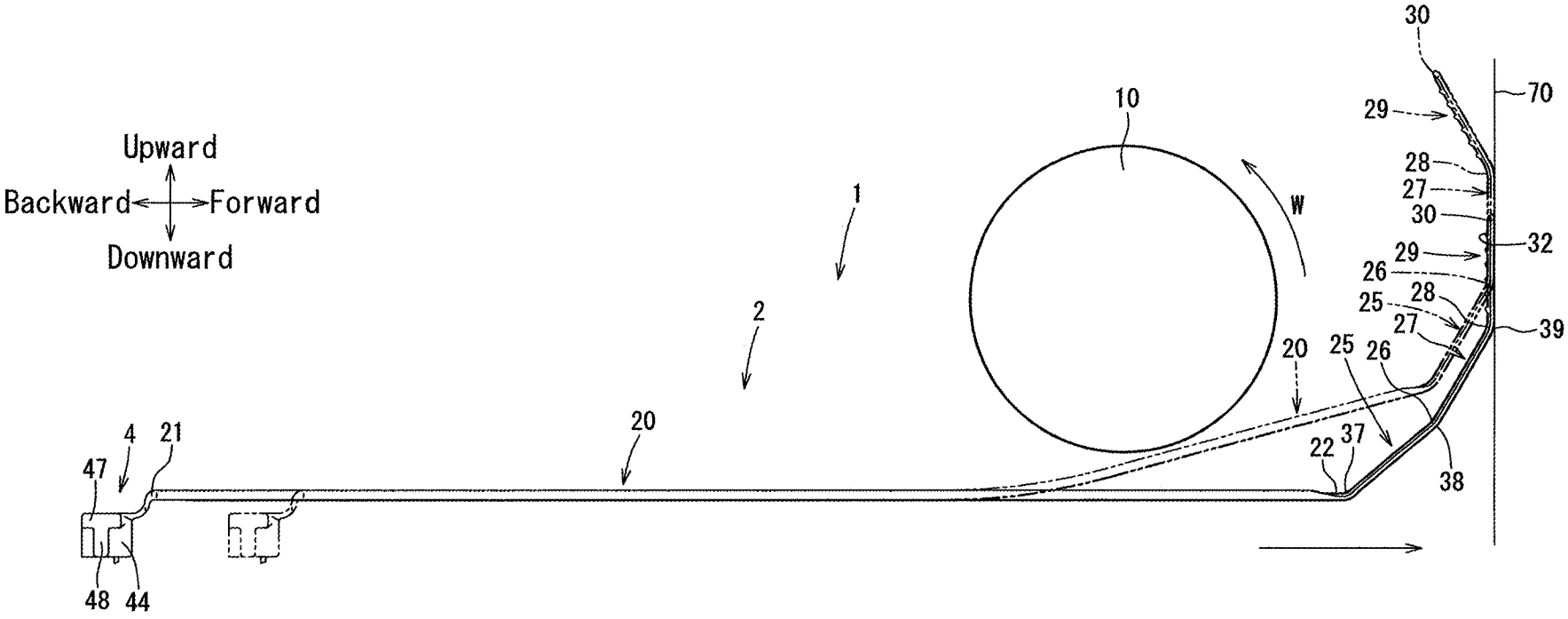
FIG. 7 is a side view of the cable tie, which illustrates a process of tying together a bundle of tied articles using the cable tie.

Next, the buckle 4 will be described. As shown in FIGS. 3 and 5, the buckle 4 may have an open-ended box-shaped member having a belt insertion hole 53 that is centrally vertically (longitudinally) formed therethrough. The belt insertion hole 53 may be configured such that the belt 2 is introduced thereinto. As shown in FIG. 6, the belt insertion hole 53 may have an inlet end 54 and an outlet end 55 respectively opening to the outside. The belt insertion hole 53 may be configured such that the belt 2 (a distal end 30 of the third linear portion 29) is inserted thereinto through the inlet end 54.

As shown in FIGS. 3 and 6, the buckle 4 may include a front wall 40, a rear wall 42, a right (first) side wall 44 and a left (second) side wall 49. As shown in FIG. 6, the front wall 40 may be connected to the proximal end 21 of the base portion 20 of the belt 2 via an upwardly curved concave quadrant arch-shaped thinned portion 40*a* formed on an upper end thereof. Further, the buckle 4 may include an engagement strip 60 formed on a vertical inner surface 41 of the front wall 40. The engagement strip 60 may be configured to flex back and forth with respect to the front wall 40. The engagement strip 60 may have an engagement claw 61 formed thereon. The engagement claw 61 may be configured to engage the rack teeth 24 formed on the base portion 20 of the belt 2 when the belt 2 is inserted into the belt insertion hole 53 of the buckle 4 in order to tie together the wiring harness 10. Further, as shown in FIG. 5, the engagement claw 61 may have a rounded portion 61*a* formed in a left edge thereof.

As shown in FIGS. 5 and 6, the rear wall 42 may be positioned opposite to the front wall across the belt insertion hole 53. The rear wall 42 may have a laterally rounded surface 43 formed in an upper end thereof and facing the belt insertion hole 53. The rounded surface 43 may preferably have the substantially same width as a width of the belt 2. The rounded surface 43 may contribute to easy insertion of the belt 2 into the belt insertion hole 53.

As shown in FIG. 5, the right side wall 44 may be connected to a right end of the front wall 40 and a right end of the rear wall 42. As shown in FIG. 1, the right side wall 44 may include a laterally outwardly projected horizontal (first) projected portion 47 that is formed on an outer surface thereof so as to extend along an upper end periphery thereof. Further, the right side wall 44 may include a laterally outwardly projected vertical (second) projected portion 48 formed on the outer surface thereof and integrated with the horizontal projected portion 47. Thus, as shown in FIG. 5, the right side wall 44 may have a thickness T1 that is substantially greater than a thickness T2 of the rear end wall 42 and a thickness T3 of the left side wall 49.

As shown in FIG. 3, the left side wall 49 may be positioned laterally opposite to the right side wall 44. The left side wall 49 may be connected to a left end of the front wall 40 and a left end of the rear wall 42. As shown in FIGS. 3 and 5, the left side wall 49 may be vertically divided in a central portion thereof, so as to be formed into two (front and rear) separate wall portions (not labeled). Thus, the left side wall 49 may have a vertical slot 56 formed between the front wall portion and the rear wall portion. The vertical slot 56 may extend along the entire length of the left side wall 49 so as to be continuous with the belt insertion hole 53 over the entire length thereof. The vertical slot 56 thus formed allows the belt 2 to be laterally introduced into the belt insertion hole 53 as necessary. Therefore, the belt 2 may be introduced into the belt insertion hole 53 not only through the inlet end 54 of the belt insertion hole 53 but also through the vertical slot 56 formed in the left side wall 49.

As shown in FIG. 5, the rear wall portion of the left side wall 49 may be specially shaped. In particular, the rear wall portion may have a projection or overhang 50 formed therealong and projecting into the belt insertion hole 53. The overhang 50 may have an inclined (inner) surface 51 hanging over and facing the belt insertion hole 53. Further, the overhang 50 may preferably have a height H equal to approximately 80 percent of a height (thickness) H1 of the left side edge of the belt 2.

As shown in FIG. 5, the front and rear wall portions of the left side wall 49 may respectively have a front vertically elongated projection 52*a* and a rear vertically elongated projection 52*b*. The front projection 52*a* and the rear projection 52*b* may respectively have vertical surfaces 59*a* and 59*b* facing each other. Further, the vertical surface 59*a* of the front vertical projection 52*a* may be inclined or curved frontward and leftward (outward) while the vertical surface 59*b* of the rear vertical projection 52*b* may be inclined or curved rearward and leftward (outward). Thus, the vertical slot 56 formed in the left side wall 49 may be gradually widened leftward (outward), so as to have a flared inlet opening 57.

Next, a standard operation for tying together the wiring harness 10 using the cable tie 1 will be described. First, the belt 2 may be applied to the wiring harness 10 from below so as to intersect with the wiring harness 10 at a substantially right angle. The belt 2 may then be looped around the wiring harness 10 in the belt wrapping direction W. Thereafter, the distal end 30 of the third linear portion 29 of the belt 2 looped around the wiring harness 10 may be introduced into the belt insertion hole 53 of the buckle 4 through the inlet end 54 of the belt insertion hole 53. Next, the distal end 30 of the third linear portion 29 introduced into the belt insertion hole 53 may be pulled and drawn from the belt insertion hole 53 through the outlet end 55 of the belt insertion hole 53. As a result, the third linear portion 29, the second linear portion 27 and the first linear portion 25 of the belt 2 may be sequentially introduced into the belt insertion hole 53. When the distal end 30 of the third linear portion 29 of the belt 2 is further pulled, the base portion 20 of the belt 2 may be introduced into the belt insertion hole 53 while flexing the engagement strip 60 formed in the belt insertion hole 53 back and forth. As a result, the belt 2 (the base portion 20) may be gradually fastened while being wrapped around the wiring harness 10. Thereafter, when the pulling operation of the belt 2 is stopped after the belt 2 is fastened to some extent, the engagement claw 61 formed on the engagement strip 60 may elastically engage one of the rack teeth 24 formed on the base portion 20 of the belt 2, so that the belt 2 may be fastened and locked by the buckle 4. Thus, the wiring harness 10 may be temporarily or substantially tied together by the cable tie 1. Further, as previously described, the buckle 4 is connected to the belt 2 via the thinned portion 40*a*. Therefore, when the belt 2 is fastened, stress produced in the belt 2 may be effectively reduced or dispersed by the thinned portion 40*a*.

Preferably, the belt 2 may be further fastened by using a specialized fastening tool (not shown) such that the wiring harness 10 can be completely tied together by the cable tie 1. In particular, a mouthpiece or tool head of the specialized tool may be fitted to the outlet end 55 of the belt insertion hole 53. Thereafter, the fastening tool may be operated, so as to further fasten the belt 2. When the belt 2 is sufficiently fastened, the engagement claw 61 of the buckle 4 may elastically engage another of the rack teeth 24 of the belt 2, so that the belt 2 may be sufficiently fastened and ultimately locked by the buckle 4. Thus, the wiring harness 10 may be securely tied together by the cable tie 1. Further, the belt 2 may be ultimately fastened by hand without using the fastening tool as necessary.

Generally, after the belt 2 is locked by the buckle 4, an excess portion of the belt 2 (i.e., a distal portion (not labeled) of the base portion 20 including the functional portion) drawn from the outlet end 55 of the belt insertion hole 53 of the buckle 4 may preferably be cut off by using cutting tools, e.g., nippers or scissors (not shown).

The wiring harness 10 is sometimes positioned adjacent to a wall-like obstacle 70 (e.g., a structural member such as a vehicle body panel). Next, an operation for tying together the wiring harness 10 using the cable tie 1 in such a case will be hereinafter described with reference to FIGS. 4 and 7 to 9. As shown in FIG. 4, first, the belt 2 may be applied to the wiring harness 10 from below in such a manner that the belt 2 intersects with the wiring harness 10 at a substantially right angle. In particular, the belt 2 may be positioned under the wiring harness 10 in such a manner that the distal end 30 of the third linear portion 29 of the belt 2 may contact the obstacle 70. At this time, the third linear portion 29 may be inclined at an angle with respect to the obstacle 70.

When the belt 2 is longitudinally pressed to the obstacle 70 in this condition (the condition shown in FIG. 4), a pressing force applied to the belt 2 may substantially be concentrated to the bent portion 39 formed between the third liner portion 29 and the second linear portion 27. As a result, the third linear portion 29 may come into contact with the obstacle 70 while relatively flexing with respect to the second linear portion 27 (solid lines in FIG. 7). Upon contact of the third linear portion 29 with the obstacle 70, the distal end 28 of the second linear portion 27 may come into contact with the obstacle 70 in a condition in whichwhile the second linear portion 27 is inclined at an angle with respect to the obstacle 70.

When the belt 2 is further pressed to the obstacle 70 in this condition, the pressing force applied to the belt 2 may substantially be concentrated to the bent portion 38 formed between the second liner portion 27 and the first linear portion 25. As a result, the second linear portion 27 may come into contact with the obstacle 70 while relatively flexing with respect to the first linear portion 25 (shown by chain double-dashed lines in FIG. 7). At this time, as shown by chain double-dashed lines in FIG. 7, due to the pressing force applied to the belt 2, the base portion 20 of the belt 2 may be flexed or deflected upward, i.e., in the belt wrapping direction W, in a middle portion thereof. Therefore, the second linear portion 27 may come into contact with the obstacle 70 while moving or sliding upward along the obstacle 70. Upon contact of the second linear portion 27 with the obstacle 70, the distal end 26 of the first linear portion 25 may come into contact with the obstacle 70 in a condition in which the first linear portion 25 is inclined at an angle with respect to the obstacle 70. Conversely, the third linear portion 29 may be spaced from the obstacle 70 so as to obliquely extend from the obstacle 70 in the belt wrapping direction W because the third linear portion 29 is inclined at the angle F with respect to the second liner portion 27 in the belt wrapping direction W.

When the belt 2 is further pressed to the obstacle 70 in this condition, the pressing force applied to the belt 2 may substantially be concentrated to the bent portion 37 formed between the first liner portion 25 and the base portion 20. As a result, the first linear portion 25 may come into contact with the obstacle 70 while relatively flexing with respect to the base portion 20 (shown by solid lines in FIG. 8). At this time, as shown by solid lines in FIG. 8, due to the pressing force applied to the belt 2, the base portion 20 may be arcuately flexed upward in the middle portion thereof. Therefore, the first linear portion 25 may come into contact with the obstacle 70 while moving or sliding upward along the obstacle 70. Upon contact of the first linear portion 25 with the obstacle 70, the distal end 22 of the base portion 20 may come into contact with the obstacle 70 in a condition in which the base portion 20 is inclined at an angle with respect to the obstacle 70. Conversely, the second linear portion 27 may be spaced from the obstacle 70 so as to obliquely extend from the obstacle 70 in the belt wrapping direction W because the second linear portion 27 is inclined at the angle D with respect to the first liner portion 25 in the belt wrapping direction W.

Figure 8:
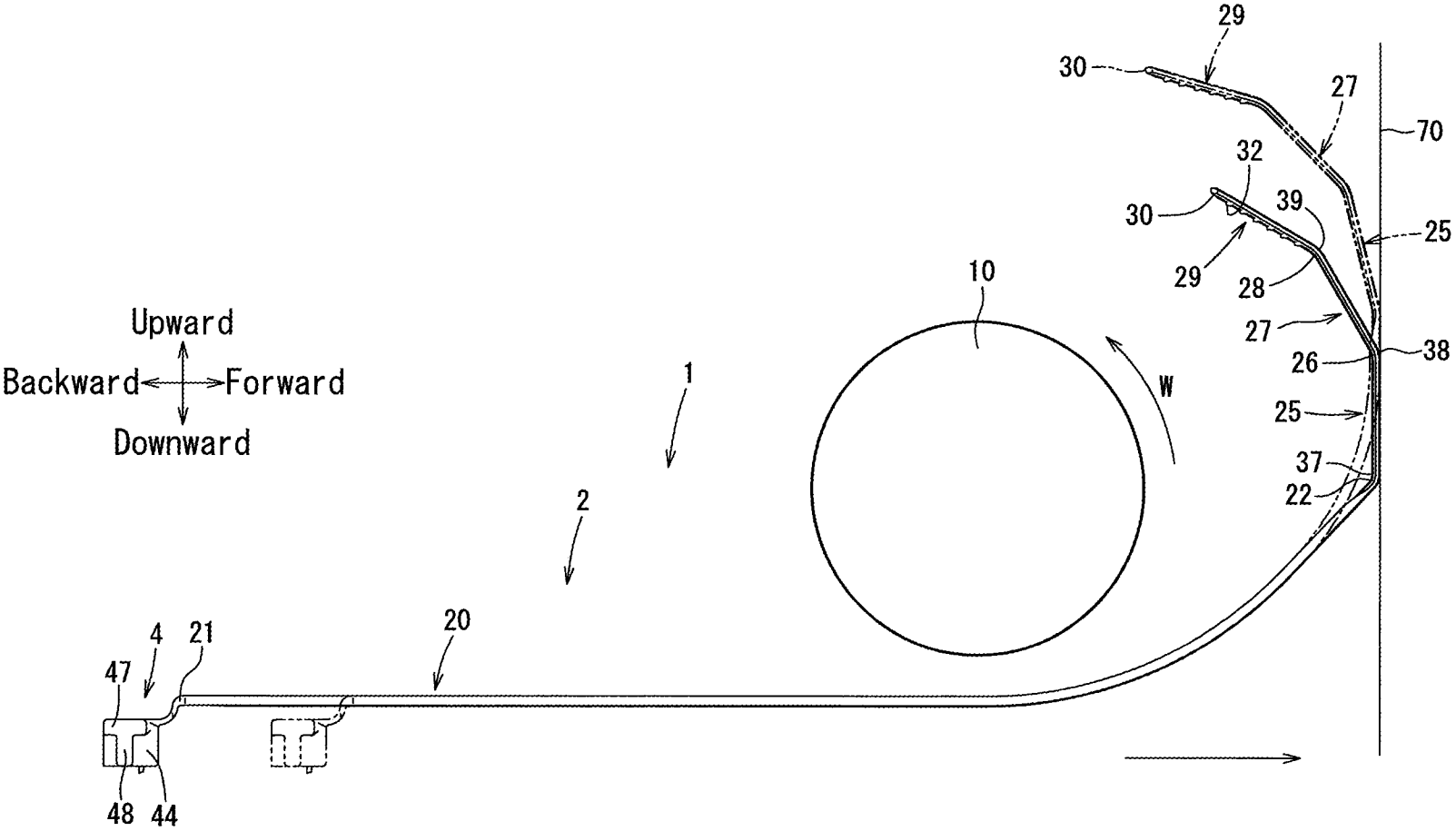
FIG. 8 is a side view of the cable tie, which illustrates the process of tying together the bundle of tied articles using the cable tie.

When the belt 2 is further pressed to the obstacle 70 in this condition, due to the pressing force applied to the belt 2, the distal portion of the base portion 20 may come into contact with the obstacle 70 (shown by chain double-dashed lines in FIG. 8). At this time, as shown by chain double-dashed lines in FIG. 8, due to the pressing force applied to the belt 2, the middle portion of the base portion 20 may be further arcuately flexed upward. Therefore, the distal portion of the base portion 20 may come into contact with the obstacle 70 while moving or sliding upward along the obstacle 70. Upon contact of the distal portion of the base portion 20 with the obstacle 70, the first linear portion 25 may be spaced from the obstacle 70 so as to obliquely extend from the obstacle 70 in the belt wrapping direction W because the first linear portion 25 is inclined at the angle B with respect to the base portion 20 in the belt wrapping direction W.

Thus, when the belt 2 is longitudinally pressed to the obstacle 70 in the condition in which the distal end 30 of the third linear portion 29 of the belt 2 contacts the obstacle 70 (FIG. 4), the third linear portion 29, the second linear portion 27 and the first linear portion 25 may be pressed against and spaced away from the obstacle 70 in a stepwise fashion while sliding upward along the obstacle 70, so as to continuously extend backward (i.e., toward the buckle 4) from the obstacle 70 in this order. As shown by chain double-dashed lines in FIG. 8, when the belt 2 is pressed to the obstacle 70 until the distal portion of the base portion 20 of the belt 2 comes into contact with the obstacle 70, all of the third linear portion 29, the second linear portion 27 and the first linear portion 25 may be spaced from the obstacle 70 so as to substantially arcuately extend backward (i.e., toward the buckle 4) from the obstacle 70. This means that the third linear portion 29, the second linear portion 27 and the first linear portion 25 may extend in the belt wrapping direction W around the wiring harness 10 in this order. Further, each of the first linear portion 25, the second linear portion 27 and the third linear portion 29 may have a substantial length. Therefore, the third linear portion 29, the second linear portion 27 and the first linear portion 25 may extend backward from the obstacle 70 over a desired distance.

According to the cable tie 1, even if the wiring harness 10 is positioned adjacent to the obstacle 70, a worker can easily pinch or hold the distal end 30 (which may be referred to as a distal end portion of the belt 2) of the third linear portion 29 of the belt 2 applied to the wiring harness 10 from below by the fingers in order to wrap the belt 2 around the wiring harness 10. Therefore, the worker can quickly wrap the belt 2 around the wiring harness 10 by holding the distal end 30 of the third linear portion 29, thereby tying together the wiring harness 10.

Further, the distal end 30 of the third linear portion 29 of the belt 2 looped around the wiring harness 10 sometimes cannot be vertically introduced into the belt insertion hole 53 of the buckle 4 through the inlet end 54 of the belt insertion hole 53. In such a case, in order to tie together the wiring harness 10 using the cable tie 1, the belt 2 may be laterally introduced into the belt insertion hole 53 of the buckle 4 through the vertical slot 56 formed in the left side wall 49. In particular, the belt 2 may be applied to the wiring harness 10 from below. The belt 2 may then be looped around the wiring harness 10 in the belt wrapping direction W. Thereafter, the first linear portion 25 of the belt 2 looped around the wiring harness 10 may be laterally introduced into the belt insertion hole 53 of the buckle 4 through the vertical slot 56 formed in the left side wall 49 (FIG. 9). Thereafter, the wiring harness 10 may be tied together by the cable tie 1 in the same manner as the standard operation described above. Thus, even in the case where the distal end 30 of the third linear portion 29 of the belt 2 looped around the wiring harness 10 cannot be vertically introduced into the belt insertion hole 53 of the buckle 4 through the inlet end 54 of the belt insertion hole 53, the wiring harness 10 can be easily and reliably tied together by the cable tie 1.

As previously described, the right side edge 33 of the first linear portion 25 may have the lower rounded surface 33*a* and the upper slanted surface 33*b* (FIG. 9), so as to have the tapered shape as a whole. Therefore, the first linear portion 25 of the belt 2 may be easily and smoothly inserted into the vertical slot 56. Further, the vertical slot 56 may have the flared inlet opening 57. This may also contribute to easy insertion of the first linear portion 25 of the belt 2 into the vertical slot 56. Thus, the first linear portion 25 of the belt 2 looped around the wiring harness 10 may be easily and smoothly introduced into the belt insertion hole 53 of the buckle 4 through the vertical slot 56 formed in the left side wall 49 of the buckle 4.

Further, as previously described, the overhang 50 formed in the rear wall portion 52*b* of the left side wall 49 of the buckle 4 may have the height H equal to approximately 80 percent of the height H1 of the right side edge 35 of the first linear portion 25 of the belt 2. Therefore, the first linear portion 25 of the belt 2 introduced into the belt insertion hole 53 of the buckle 4 may be effectively prevented from being disengaged or slipped from the buckle 4 via the vertical slot 56.

According to the cable tie 1 of the first embodiment, the belt 2 may include the base portion 20 and the functional portion. The functional portion may include the first linear portion 25, the second linear portion 27 and the third linear portion 29 that are connected to each other at the predetermined angles (i.e., the angle D and the angle F). Further, the first liner portion 25 of the functional portion may be connected to the base portion 20 at the predetermined angle (i.e., the angle B). Therefore, in the case where the wiring harness 10 is positioned adjacent to the obstacle 70, when the belt 2 positioned under the wiring harness 10 is pressed to the obstacle 70 after the distal end 30 of the third linear portion 29 of the belt 2 contacts the obstacle 70, the third linear portion 29, the second linear portion 27 and the first linear portion 25 may turn stepwise at the obstacle 70 in this order so as to gradually overhang the wiring harness 10 in the belt wrapping direction W. Further, the third linear portion 29 may be inclined at an angle equal to a sum of the angles B, D and F with respect to the obstacle 70. Therefore, even if the wiring harness 10 is positioned adjacent to the obstacle 70, the worker can easily and quickly wrap the belt 2 around the wiring harness 10 by holding the distal end 30 of the third linear portion 29.

Further, the first angle B, the second angle D and the third angle F are respectively determined to 10 degrees, 20 degrees and 30 degrees. In addition, the length L2 of the first linear portion 25, the length L3 of the second linear portion 27 and the length L4 of the third linear portion 29 are determined to be substantially equal to each other. Therefore, the third linear portion 29, the second linear portion 27 and the first linear portion 25 (i.e., the functional portion of the belt 2) may be well-balanced in structure and function.

Further, the sum of the length L2 of the first linear portion 25, the length L3 of the second linear portion 27 and the length L4 of the third linear portion 29 (i.e., the length of the functional portion of the belt 2) may be determined to be equal to 28±10 percent of the overall length L of the belt 2. Such a ratio of the length of the functional portion of the belt 2 to the overall length L of the belt 2 may contribute to an increase in function of the functional portion of the belt 2 and an increase in ease of handling of the belt 2.

Further, the buckle 4 may include the vertical slot 56 that is continuous with the belt insertion hole 53. Therefore, the belt 2 can be laterally introduced into the belt insertion hole 53 of the buckle 4 through the vertical slot 56 instead of the inlet end 54. Further, the vertical slot 56 may have the flared inlet opening 57. Therefore, the belt 2 can be easily and smoothly introduced into the belt insertion hole 53 of the buckle 4 through the vertical slot 56.

Further, the right side edge 33 of the belt 2 may have the tapered shape. Therefore, the belt 2 can be easily and smoothly introduced into the belt insertion hole 53 of the buckle 4 through the vertical slot 56.

Further, the buckle 4 may include the right side wall 44 having the thickness T1 greater than the thickness T2 of the rear end wall 42 and the thickness T3 of the left side wall 49. Therefore, the buckle 4 may have a desired strength regardless of the presence of the vertical slot 56 formed in the left side wall 49.

Further, the left side wall 49 of the buckle 4 may have the overhang 50 formed in rear wall portion and hanging over the belt insertion hole 53. The overhang 50 may have the inclined surface 51 facing the belt insertion hole 53. Further, the overhang 50 may have the height H equal to approximately 80 percent of the height H1 of the left side edge 35 of the belt 2. Therefore, the overhang 50 may effectively interfere with the left side edge 35 of the belt 2 introduced into the belt insertion hole 53, thereby preventing the belt 2 from being disengaged or slipped from the buckle 4 through the vertical slot 56.

Further, the vertical slot 56 of the buckle 4 may have the flared inlet opening 57. Therefore, the belt 2 can be easily introduced into the belt insertion hole 53 of the buckle 4 through the vertical slot 56.

Next, a second detailed representative embodiment will now be described with reference to FIGS. 10 to 13. Further, because the second embodiment relates to the first embodiment, only the constructions and elements that are different from the first embodiment will be explained in detail. Elements that are the same in the first and second embodiments will be identified by the same reference numerals and a detailed description of such elements may be omitted.

Similar to the cable tie 1 of the first embodiment, a cable tie 101 of the second embodiment may be integrally formed as a unit by integral molding of a rigid synthetic resin. The cable tie 101 may include a desired length of flexible belt 102 and the buckle 4. The cable tie 101 may be different from the cable tie 1 of the first embodiment in that the belt 102 is structurally different from the belt 2 of the first embodiment. In particular, as shown in FIGS. 10 to 13, unlike the first embodiment, the functional portion of the belt 102 may include only the first linear portion 25 and the second linear portion 27. Further, in this embodiment, the second linear portion 27 may have the gear tooth-shaped projections 32 that are formed in a central portion of an inner surface thereof. The projections 32 may preferably be arranged at a constant pitch distance in a longitudinal direction of the second linear portion 27.

Figure 10:
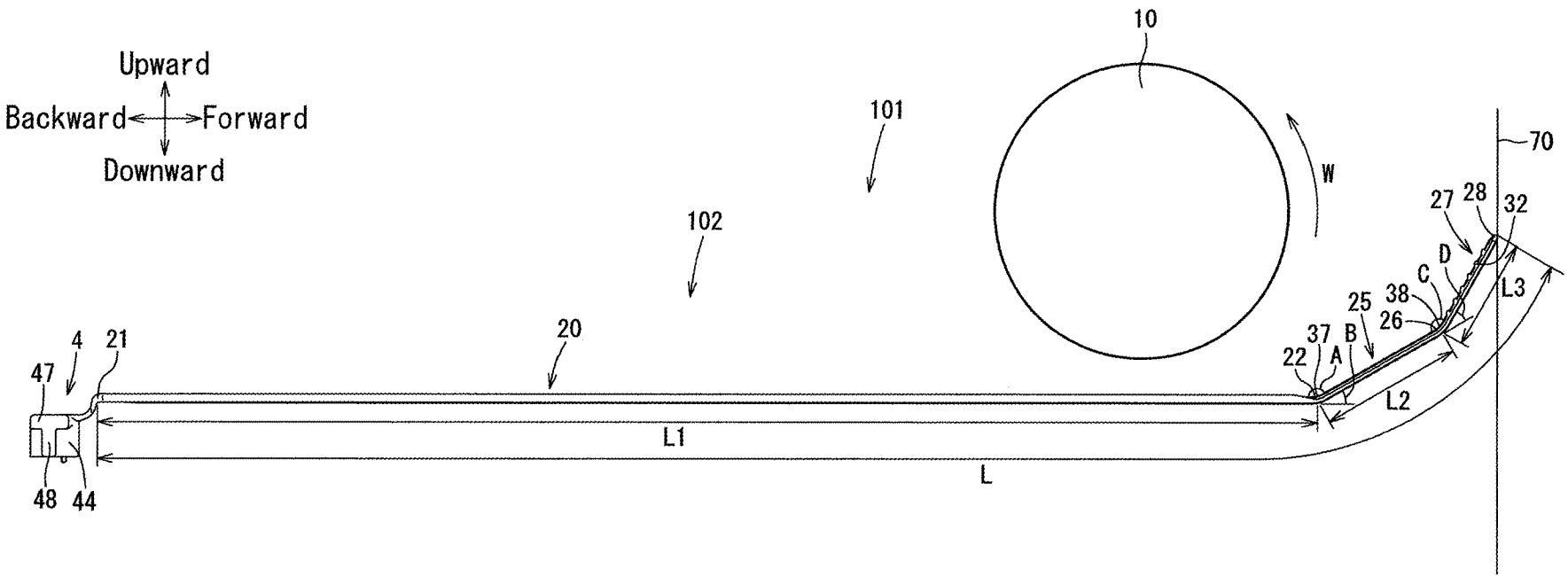
FIG. 10 is a side view of a cable tie according to a second representative embodiment of the present disclosure, which is viewed from the right.

As shown in FIG. 10, similar to the first embodiment, the first linear portion 25 may be inclined at the (first) angle B with respect to the base portion 20 in the belt wrapping direction W. Further, the second linear portion 27 may be inclined at the (second) angle D with respect to the first liner portion 25 in the belt wrapping direction W.

However, in this embodiment, the first angle B and the second angle D may respectively be determined to 30 degrees. Generally, the angle B and the angle D may be determined to meet the following requirements:

1) the angle B≤the angle D 2) the angle B+the angle D≤90 degrees.

As shown in FIG. 10, in this embodiment, the length L2 of the first linear portion 25 is determined to be greater than the length L3 of the second linear portion 27. Further, the length of the functional portion of the belt 102 (i.e., a sum of the length L2 of the first linear portion 25 and the length L3 of the second linear portion 27, or a difference between the overall length L of the belt 102 and the length L1 of the base portion 20 of the belt 102) may be determined to be equal to 28±10 percent of the overall length L of the belt 102. Further, the length L2 of the first linear portion 25 may be determined to be equal to or smaller than the length L3 of the second linear portion 27 as necessary.

Figure 11:
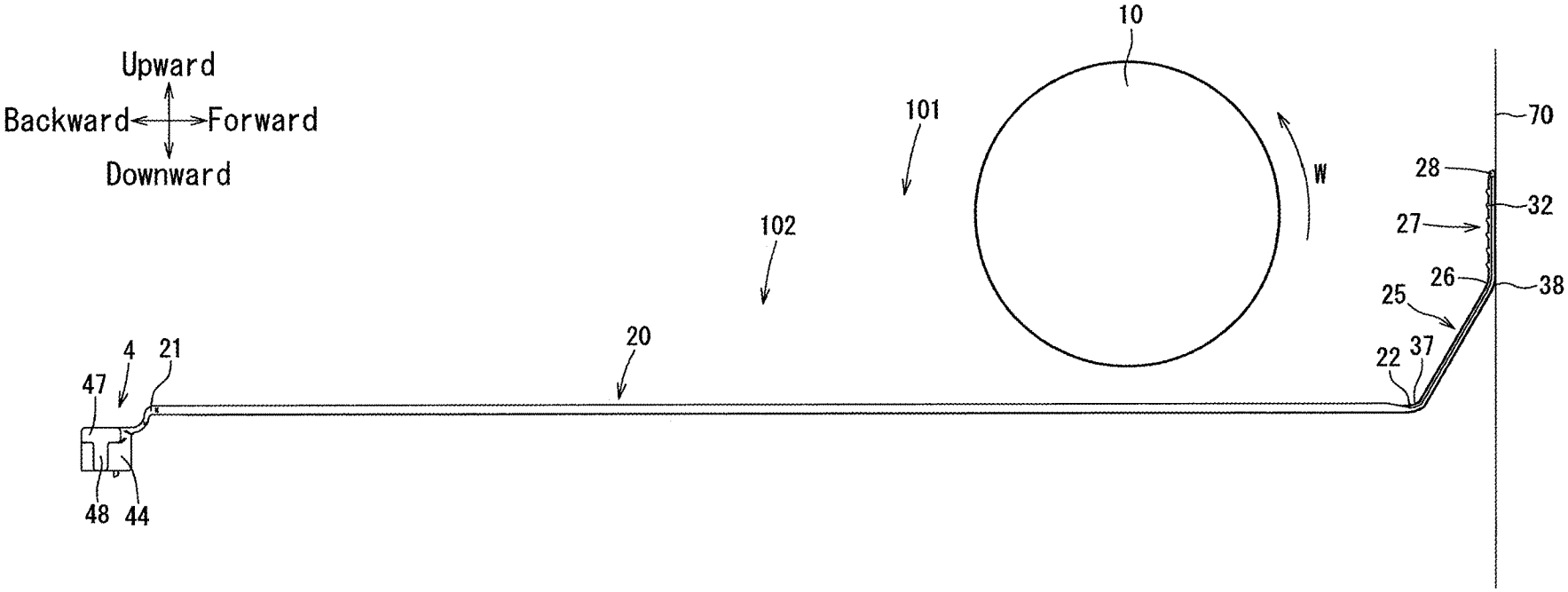
FIG. 11 is a side view of the cable tie, which illustrates a process of tying together a bundle of tied articles using the cable tie.
Figure 12:
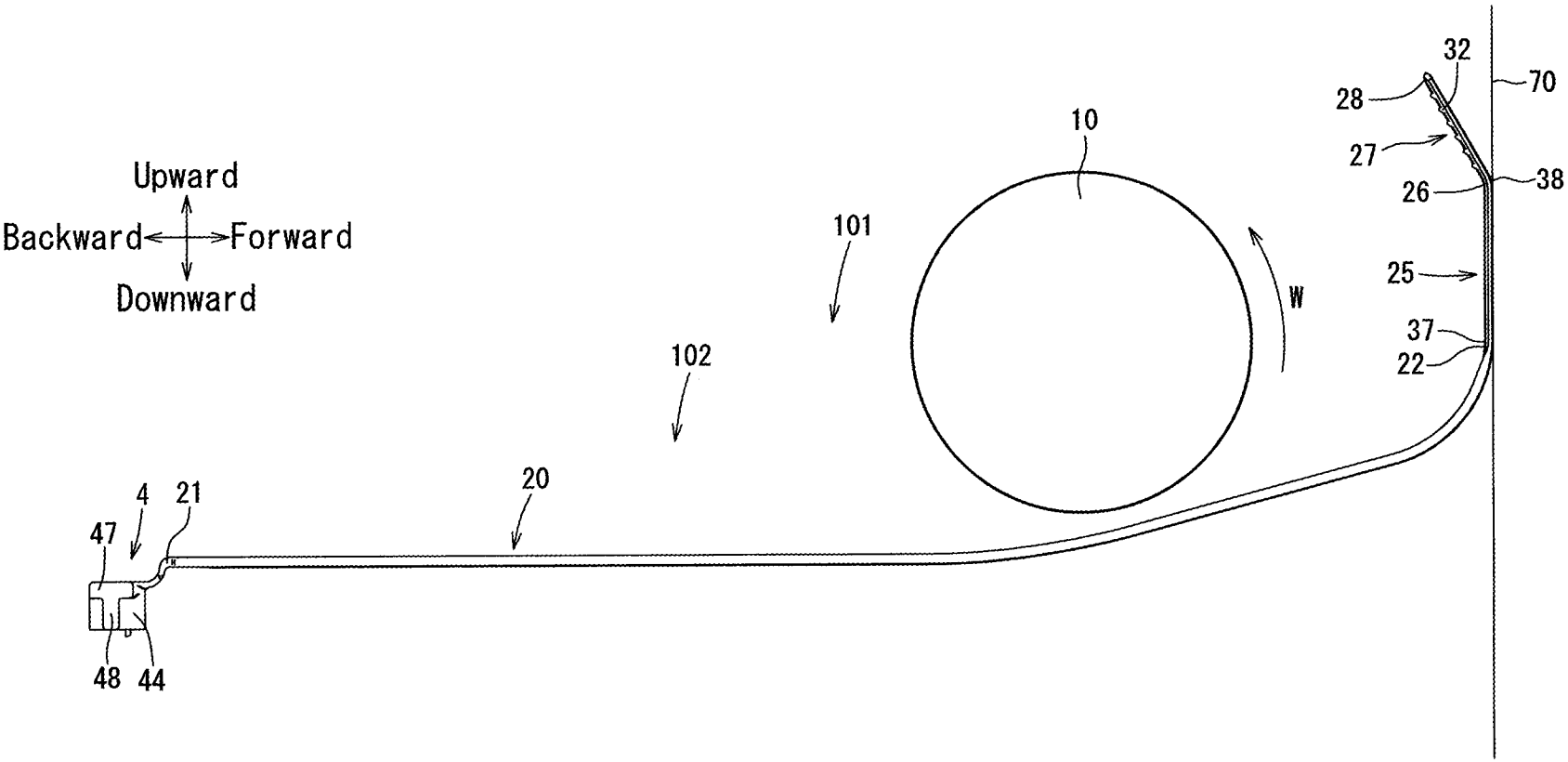
FIG. 12 is a side view of the cable tie, which illustrates the process of tying together the bundle of tied articles using the cable tie.
Figure 13:
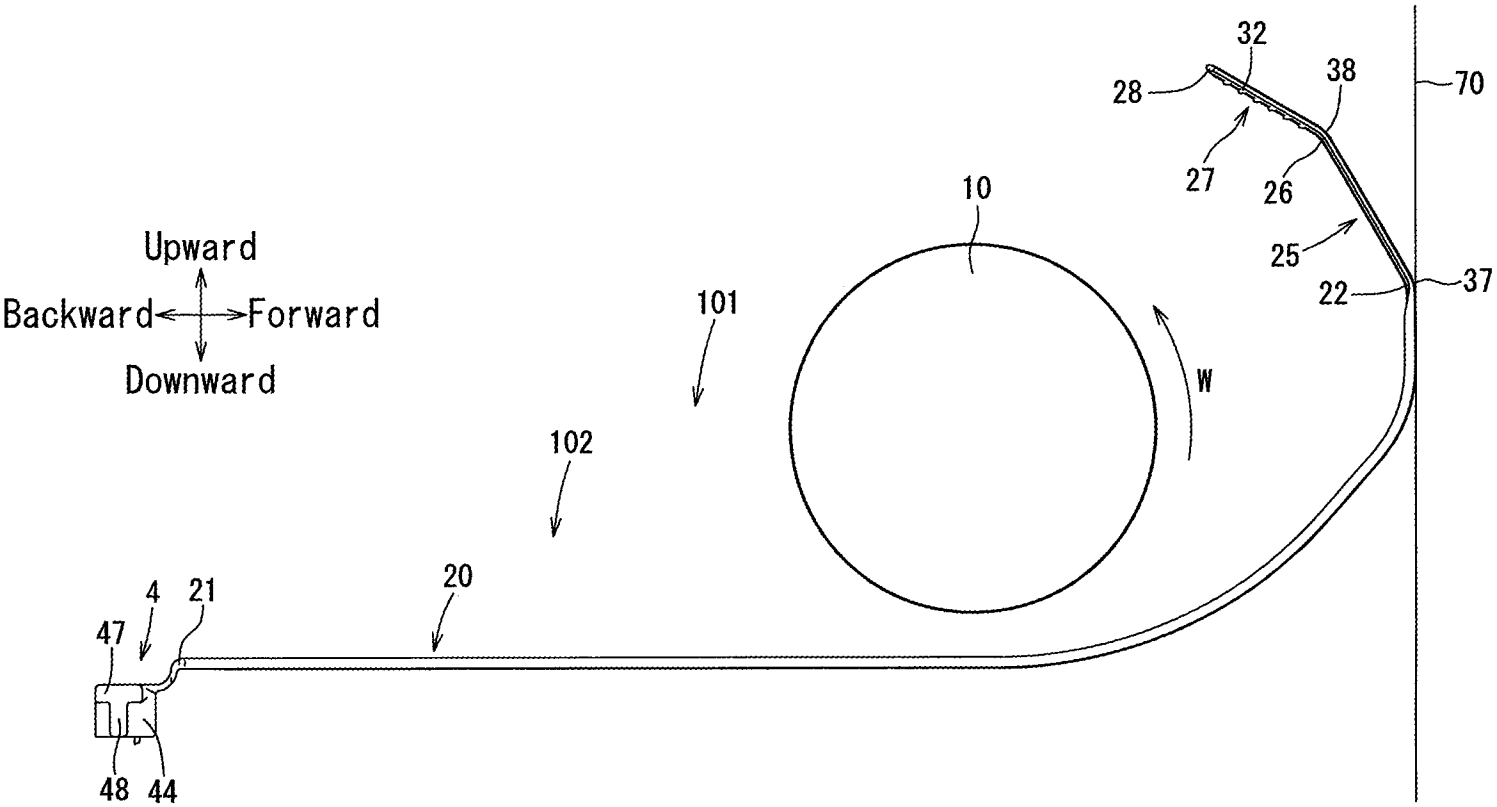
FIG. 13 is a side view of the cable tie, which illustrates the process of tying together the bundle of tied articles using the cable tie.

According to the cable tie 101, in a condition where the belt 102 is positioned under the wiring harness 10 with the distal end 28 of the second linear portion 27 contacting the obstacle 70 (FIG. 10), when the belt 102 is longitudinally pressed to the obstacle 70, the second linear portion 27 and the first linear portion 25 may be pressed against and spaced away from the obstacle 70 in a stepwise fashion while sliding upward along the obstacle 70, so as to continuously extend backward (i.e., toward the buckle 4) from the obstacle 70 in this order (FIGS. 11 to 13). As shown in FIG. 13, when the belt 102 is pressed to the obstacle 70 until the distal portion of the base portion 20 of the belt 102 comes into contact with the obstacle 70, both of the second linear portion 27 and the first linear portion 25 may be spaced away from the obstacle 70 so as to substantially arcuately extend backward (i.e., toward the buckle 4) from the obstacle 70. This means that the second linear portion 27 and the first linear portion 25 may extend in the belt wrapping direction W around the wiring harness 10 in this order. Further, each of the first linear portion 25 and the second linear portion 27 may have a substantial length. Therefore, the second linear portion 27 and the first linear portion 25 may extend backward from the obstacle 70 over a desired distance.

Further, according to the cable tie 101, even if the wiring harness 10 is positioned adjacent to the obstacle 70, the worker can easily pinch or hold the distal end 28 (which may be referred to as a distal end portion of the belt 102) of the second linear portion 27 of the belt 102 applied to the wiring harness 10 from below by the fingers in order to wrap the belt 102 around the wiring harness 10. Therefore, the worker can quickly wrap the belt 102 around the wiring harness 10 by holding the distal end 28 of the second linear portion 27, thereby tying together the wiring harness 10. Further, even in a case where the distal end 28 of the second linear portion 27 of the belt 102 looped around the wiring harness 10 cannot be vertically introduced into the belt insertion hole 53 of the buckle 4 through the inlet end 54 of the belt insertion hole 53, the first linear portion 25 of the belt 102 may be laterally introduced into the belt insertion hole 53 of the buckle 4 through the vertical slot 56 formed in the left side wall 49. Therefore, even in such a case, the wiring harness 10 can be easily and reliably tied together by the cable tie 101.

Figure 14:
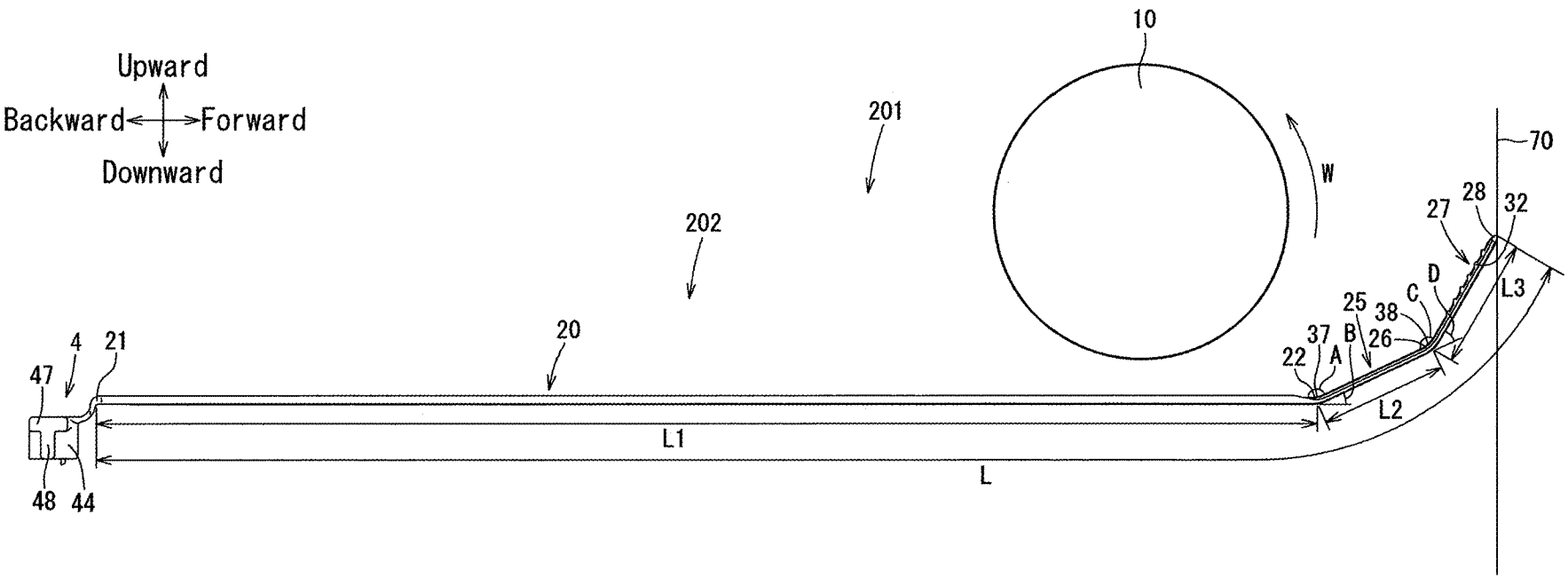
FIG. 14 is a side view of a cable tie according to a third representative embodiment of the present disclosure, which is viewed from the right.

Next, a third detailed representative embodiment will now be described with reference to FIG. 14. Further, because the third embodiment relates to the second embodiment, only the constructions and elements that are different from the first embodiment will be explained in detail. Elements that are the same in the first and second embodiments will be identified by the same reference numerals and a detailed description of such elements may be omitted.

A cable tie 201 of the third embodiment may include a desired length of flexible belt 202 and the buckle 4. The cable tie 201 may be different from the cable tie 101 of the second embodiment in that the belt 202 is structurally different from the belt 102 of the second embodiment. In particular, unlike the second embodiment, the first angle B may be determined to 25 degrees. The cable tie 201 may have the substantially same function as the cable tie 101 of the second embodiment.

Figure 15:
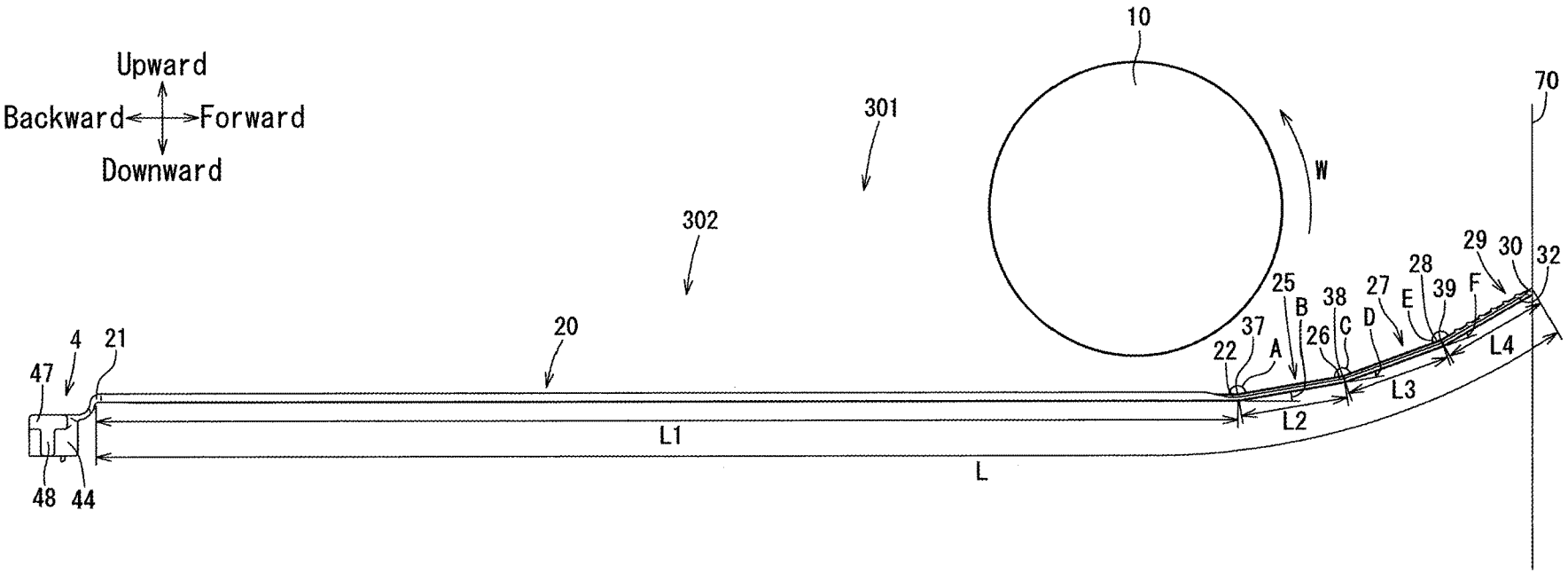
FIG. 15 is a side view of a cable tie according to a fourth representative embodiment of the present disclosure, which is viewed from the right.

Next, a fourth detailed representative embodiment will now be described with reference to FIG. 15. Further, because the fourth embodiment relates to the first embodiment, only the constructions and elements that are different from the first embodiment will be explained in detail. Elements that are the same in the first and fourth embodiments will be identified by the same reference numerals and a detailed description of such elements may be omitted.

A cable tie 301 of the fourth embodiment may include a desired length of flexible belt 302 and the buckle 4. The cable tie 301 may be different from the cable tie 1 of the first embodiment in that the belt 302 is structurally different from the belt 2 of the first embodiment. In particular, unlike the first embodiment, each of the second angle D and the third angle F may be determined to 10 degrees. The cable tie 301 may have the substantially same function as the cable tie 1 of the first embodiment.

Naturally, various changes and modifications may be made to the present disclosure without departing from the scope of the disclosure. For example, in the first embodiment, the functional portion of the belt 2 may include a fourth linear portion connected to the distal end 30 of the third linear portion 29 and inclined at a fourth angle with respect to the third linear portion 29. In such a case, the first angle B, the second angle D, the third angle F and the fourth angle may be determined to meet the requirements "the first angle B≤the second angle D≤the third angle F≤the fourth angle" and "the first angle B+the second angle D+the third angle F+the fourth angle≤90 degrees." Further, the functional portion of the belt 2 may include additional linear portions in addition to the fourth linear portion.

Further, in the first embodiment, the length L2 of the first linear portion 25, the length L3 of the second linear portion 27 and the length L4 of the third linear portion 29 may be determined to be equal to each other. However, the length L2, the length L3 and the length L4 may be determined to be different from each other at a difference of up to 10 percent.

Figure 16:
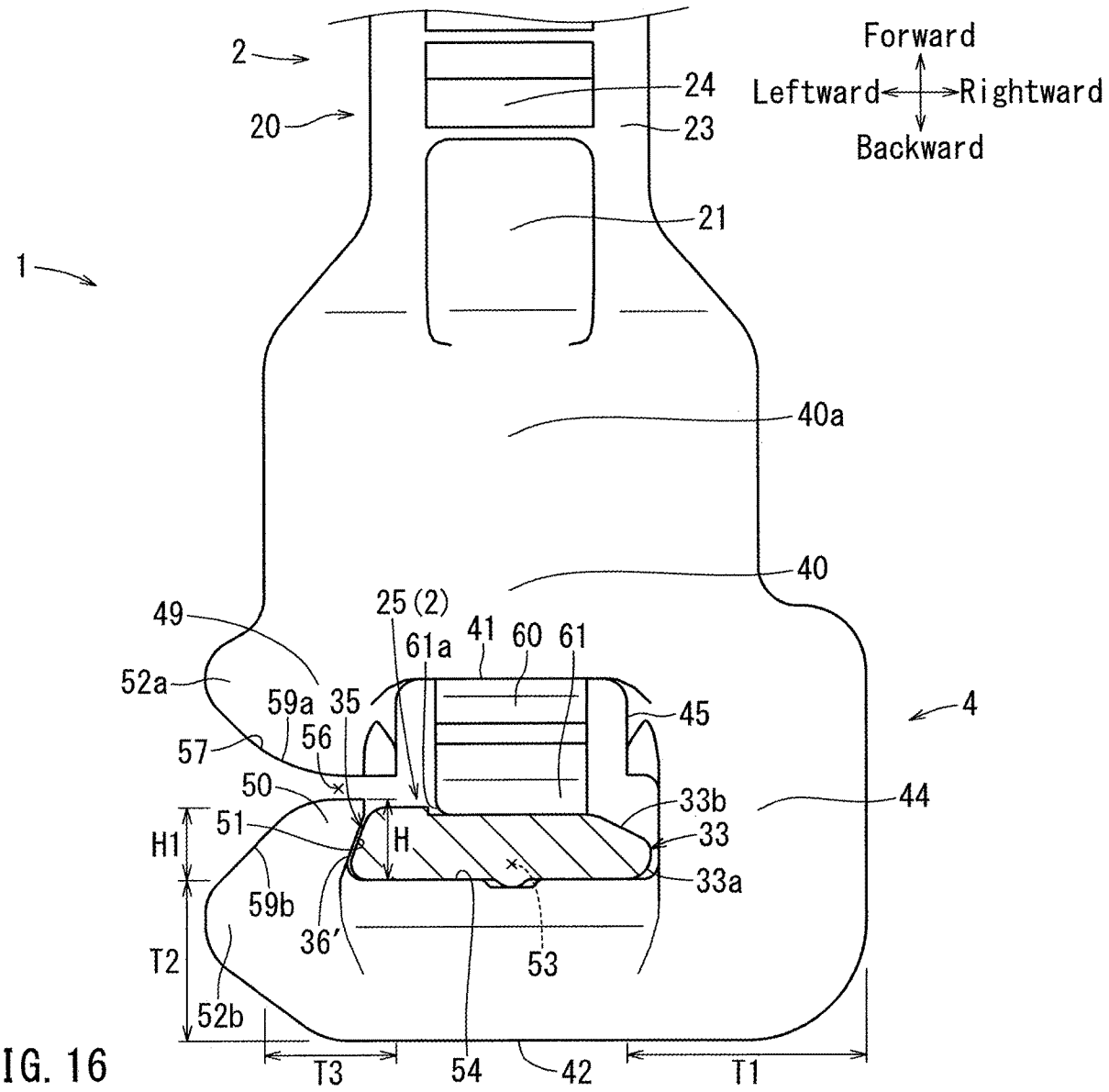
FIG. 16 is a view similar to FIG. 9, which illustrates a belt of a cable tie according to a first modified embodiment of the first embodiment.

Further, in the first embodiment, the left side edge 35 of the first linear portion 25 may have the perpendicular end surface 36 (FIG. 9). However, as shown in FIG. 16 (a first modified embodiment), the left side edge 35 of the first linear portion 25 may have a slanted end surface 36' that is configured to be parallel to the inclined surface 51 of the overhang 50 when the belt 2 is introduced into the belt insertion hole 53 of the buckle 4. According to the modified embodiment of the first embodiment, the belt 2 introduced into the belt insertion hole 53 of the buckle 4 may be more effectively prevented from being disengaged or slipped from the buckle 4 through the vertical slot 56. Similarly, in each of the second to fourth embodiment, the left side edge 35 of the first linear portion 25 may be modified in the same manner as the first embodiment.

Figure 17:
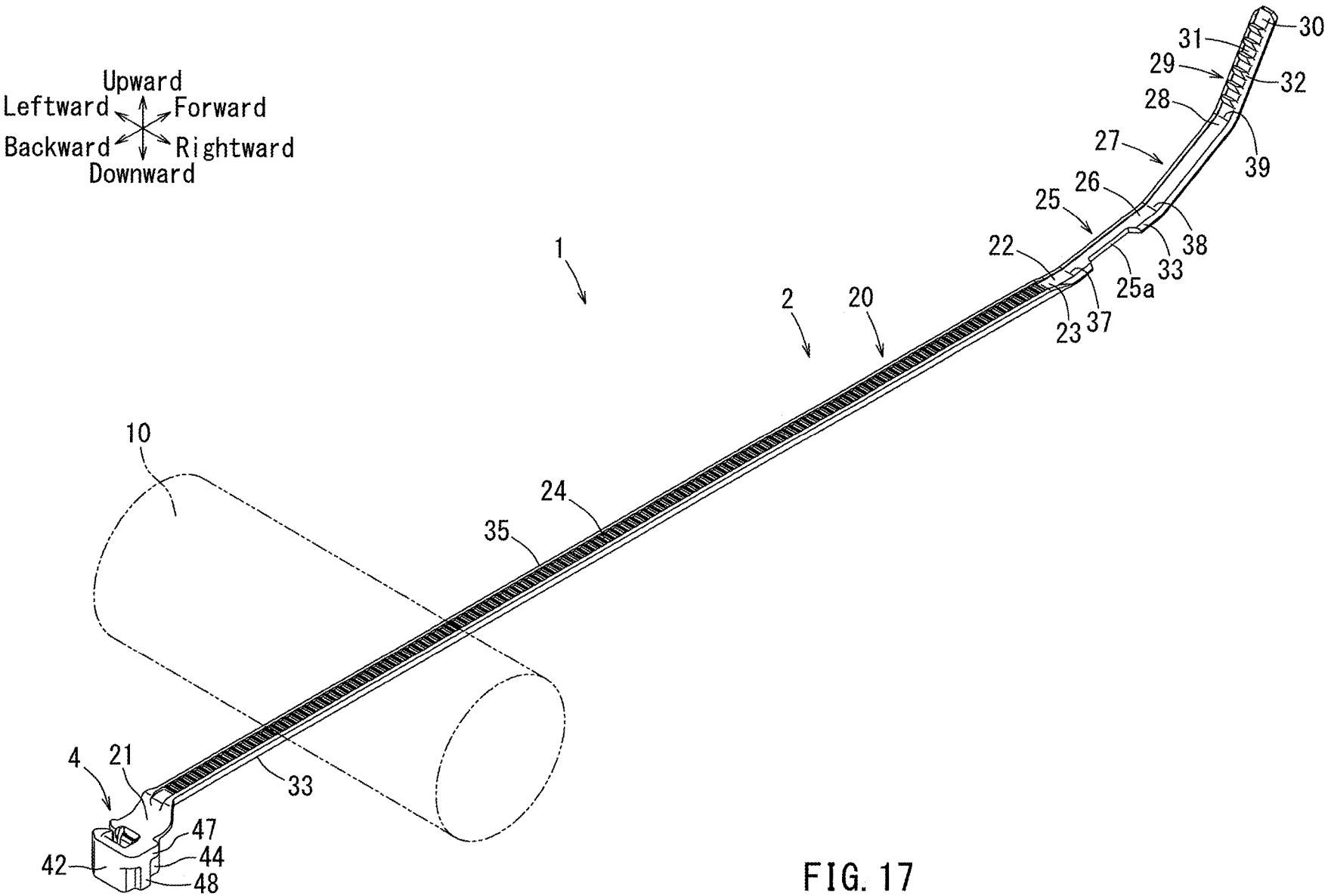
FIG. 17 is an overall perspective view of a cable tie according to a second modified embodiment of the first embodiment, which is viewed from above.

The first embodiment may be further modified. In particular, as shown in FIG. 17 (a second modified embodiment), the right side edge 33 of the belt 2 may be partially removed in the first linear portion 25, thereby forming a cutout or removed portion 25*a* that penetrates the first linear portion 25 in a belt thickness direction. The removed portion 25*a* may serve as a sign that indicates a position of the first linear portion 25. Therefore, the worker can easily and reliably introduce the first linear portion 25 into the belt insertion hole 53 of the buckle 4 through the vertical slot 56 with the help of the removed portion 25*a* even when the worker cannot see the first linear portion 25. Similarly, in each of the second to fourth embodiment, the right side edge 33 of the first linear portion 25 may be modified in the same manner as the first embodiment.

Figure 18:
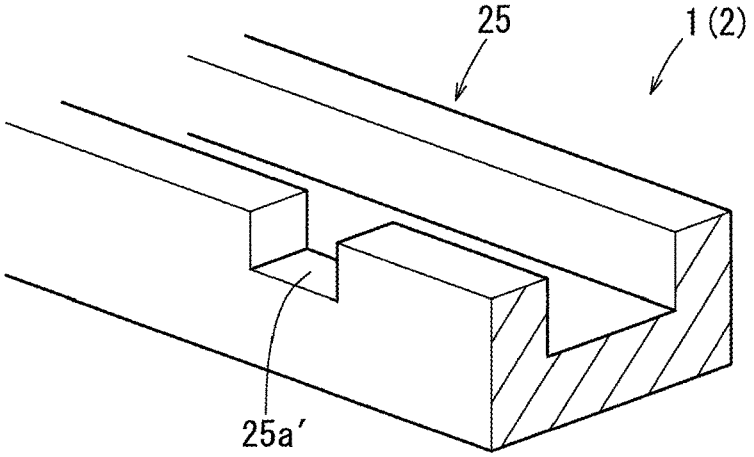
FIG. 18 is a schematic partial perspective view of the belt of the cable tie according to the second modified embodiment, which shows a modified form of a removed portion formed in the belt.
Figure 19:
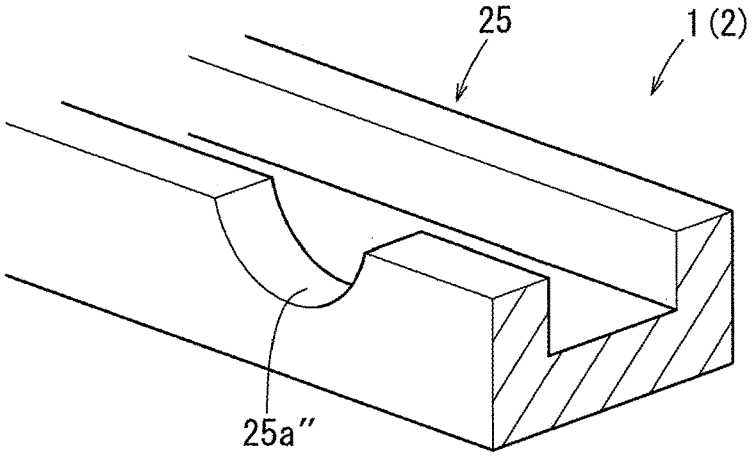
FIG. 19 is a schematic partial perspective view of the belt of the cable tie according to the second modified embodiment, which shows a modified form of the removed portion formed in the belt.
Figure 20:
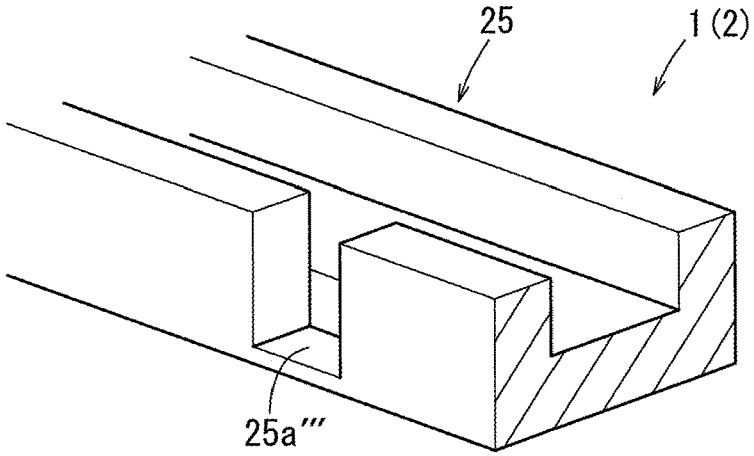
FIG. 20 is a schematic partial perspective view of the belt of the cable tie according to the second modified embodiment, which shows a modified form of the removed portion formed in the belt.

Further, the removed portion 25*a* formed in the first linear portion 25 may be variously changed in shape. For example, as shown in FIG. 18, the removed portion 25*a* may be changed to a shallow rectangular recessed portion 25*a*' that does not penetrate the first linear portion 25 in the belt thickness direction. Further, as shown in FIG. 19, the removed portion 25*a* may be changed to a semicircular recessed portion 25*a*" that does not penetrate the first linear portion 25 in the belt thickness direction. Further, as shown in FIG. 20, the removed portion 25*a* may be changed to a deep rectangular recessed portion 25*a*'" that does not penetrate the first linear portion 25 in the belt thickness direction.

Figure 21:
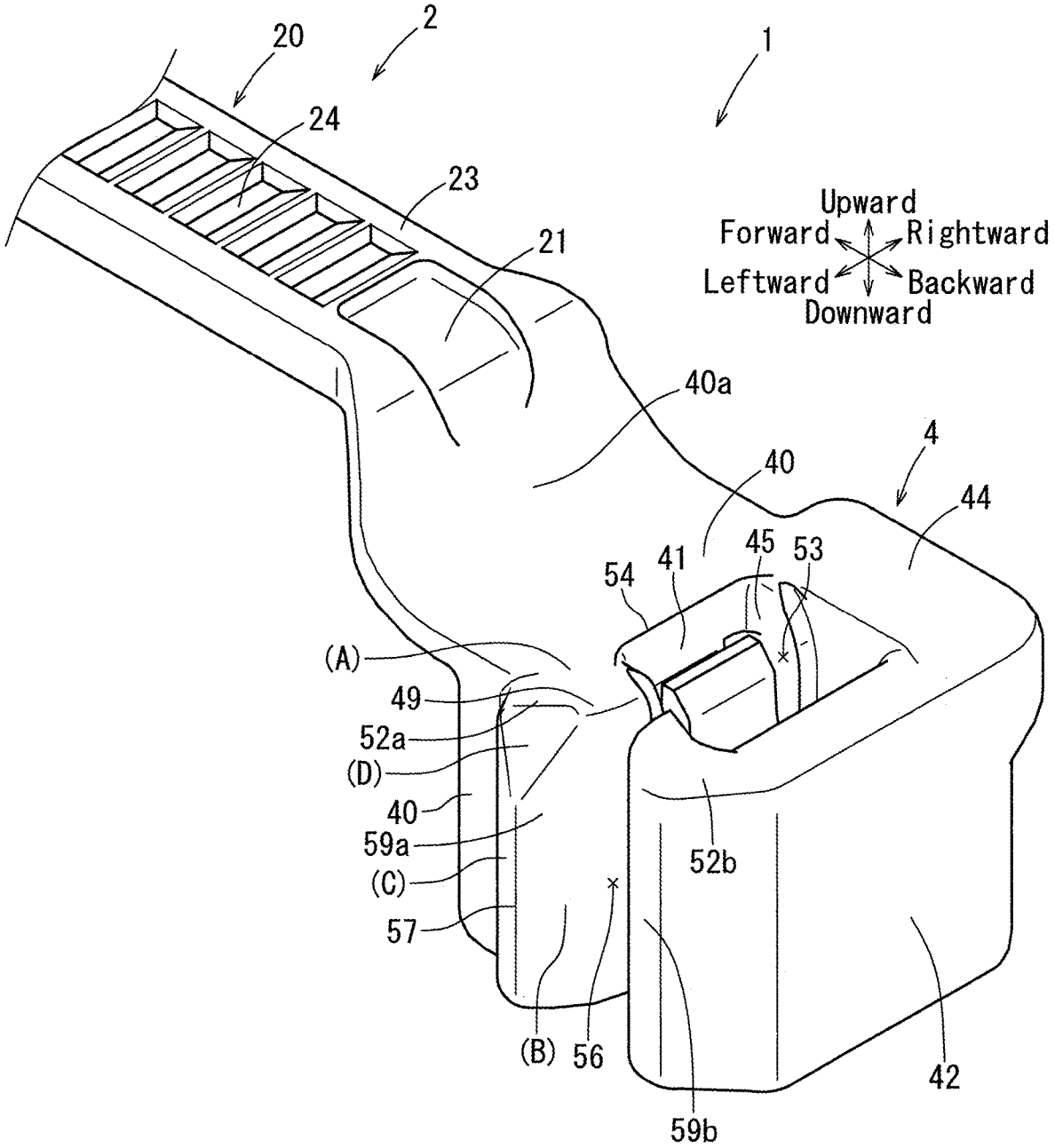
FIG. 21 is a view similar to FIG. 3, which illustrates a buckle of a cable tie according to a third modified embodiment of the first embodiment.
Figure 22:
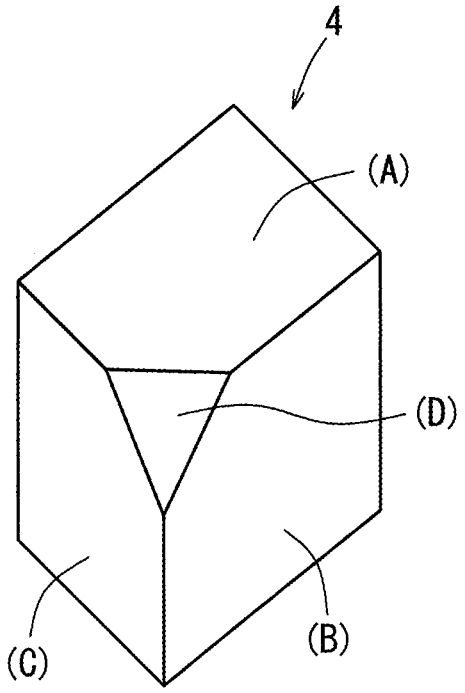
FIG. 22 is a schematic partial perspective view of the buckle of the cable tie according to the third modified embodiment, which schematically shows a form of an inclined surface formed on the buckle.

The first embodiment may be further modified. In particular, as shown in FIGS. 21 and 22 (a third modified embodiment), at least one of the front wall portion (the front vertical projection 52*a*) and the rear wall portion (the rear vertical projection 52*b*) of the left side wall 49 of the buckle 4 may be modified. For example, the front wall portion of the left side wall 49 of the buckle 4 may have a triangular chamfered portion or inclined surface (D) that extends over an upper surface (A), an inner surface (B) and an outer surface (C) thereof. Further, the inner surface (B) may include the vertical surface 59*a* of the front vertical projection 52*a* formed in the front wall portion of the left side wall 49. The inclined surface (D) may contribute to easy insertion of the first linear portion 25 of the belt 2 into the vertical slot 56. Similarly, in each of the second to fourth embodiment, the buckle 4 may be modified in the same manner as the first embodiment.

Figure 23:
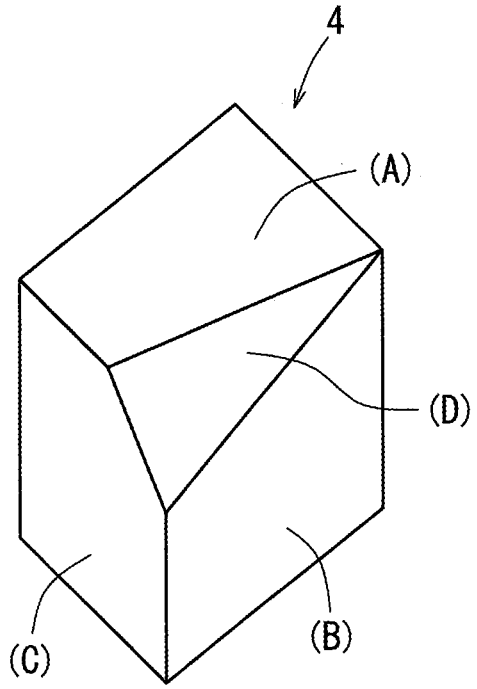
FIG. 23 is a schematic partial perspective view of the buckle of the cable tie according to the third modified embodiment, which schematically shows a modified form of the inclined surface formed on the buckle.
Figure 24:
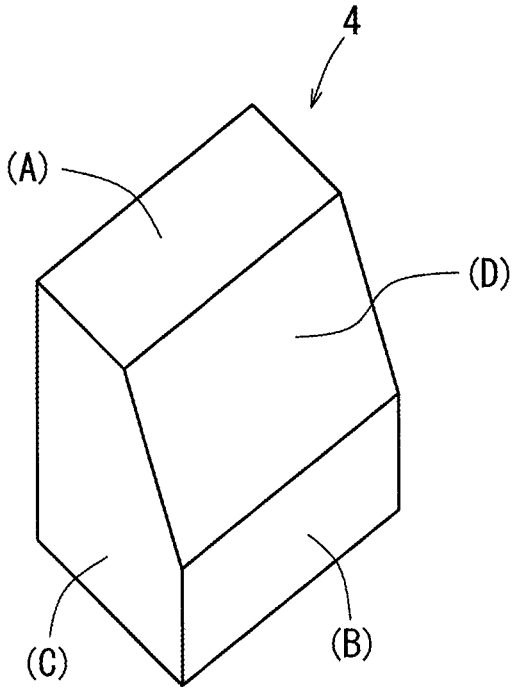
FIG. 24 is a schematic partial perspective view of the buckle of the cable tie according to the third modified embodiment, which schematically shows a modified form of the inclined surface formed on the buckle.
Figure 25:
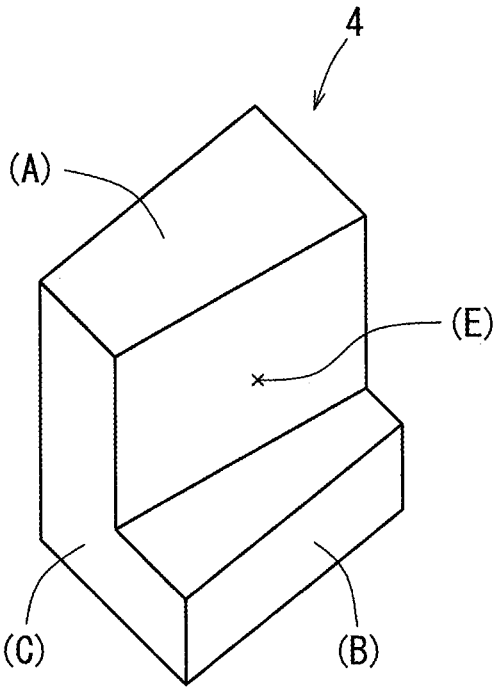
FIG. 25 is a schematic partial perspective view of the buckle of the cable tie according to the third modified embodiment, which schematically shows a modified form of the inclined surface formed on the buckle.

Further, the inclined surface (D) formed in the front wall portion of the left side wall 49 may be variously changed or modified in shape. For example, as shown in FIG. 23, the inclined surface (D) may have a laterally elongated triangular shape. Further, as shown in FIG. 24, the inclined surface (D) may have a rectangular shape. Further, as shown in FIG. 25, the front wall portion of the left side wall 49 of the buckle 4 may have a cutout (E) instead of the inclined surface (D).

Further, the cable tie 1 of the first embodiment may be modified. In particular, the buckle 4 may be provided with a connecting member (e.g., an anchor), so as to be connected to a vehicle body. According to the cable tie 1 thus modified, the wiring harness 10 tied together by the cable tie 1 can be secured to the vehicle body via the connecting member.

Representative examples of the present disclosure have been described in detail with reference to the attached drawings. This detailed description is merely intended to teach a person of skill in the art further details for practicing preferred aspects of the present disclosure and is not intended to limit the scope of the disclosure. Only the claims define the scope of the claimed disclosure. Therefore, combinations of features and steps disclosed in the foregoing detail description may not be necessary to practice the disclosure in the broadest sense, and are instead taught merely to particularly describe detailed representative examples of the disclosure. Moreover, the various features taught in this specification may be combined in ways that are not specifically enumerated in order to obtain additional useful embodiments of the present disclosure.

What is claimed is:

1. A cable tie, comprising:

an elongated belt; and a buckle connected to a proximal end portion of the belt, wherein the buckle has a belt insertion hole extending longitudinally between an upper end of the buckle and a lower end of the buckle, and a slot continuous with the belt insertion hole, wherein the belt insertion hole is configured such that the belt is longitudinally introduced thereinto, wherein the slot is configured such that the belt is laterally introduced into the belt insertion hole therethrough, wherein the slot includes a flared inlet opening that is gradually widened outward, wherein the buckle includes a front wall connected to the belt, a rear wall positioned opposite to the front wall across the belt insertion hole, a first side wall connected to an end of the front wall and an end of the rear wall, and a second side wall positioned opposite to the first side wall, wherein an upper portion of each of the front wall, the rear wall, the first side wall and the second side wall define an upper opening of the belt insertion hole and a lower portion of each of the front wall, the rear wall, the first side wall and the second side wall define a lower opening of the belt insertion hole; and wherein the slot is formed in the second side wall.

2. The cable tie as defined in claim 1, wherein the belt includes a first side edge and a second side edge positioned opposite to each other, and wherein the first side edge is formed into a tapered shape.

3. The cable tie as defined in claim 1, wherein the first side wall has a thickness greater than a thickness of the rear end wall and a thickness of the second side wall.

4. The cable tie as defined in claim 1, wherein the buckle includes a projection formed therealong and projecting into the belt insertion hole, and wherein the projection has an inner surface facing the belt insertion hole.

5. The cable tie as defined in claim 4, wherein the belt includes a first side edge and a second side edge positioned opposite to each other, and wherein the second side edge has an end surface that is configured to be parallel to the inner surface of the projection when the belt is introduced into the belt insertion hole.

6. The cable tie as defined in claim 5, wherein the projection has a height not less than 60 percent of a thickness of the second side edge of the belt.

7. The cable tie as defined in claim 1, wherein the buckle has a pair of vertically elongated projections respectively having surfaces facing each other, and wherein the surfaces of the projections are respectively inclined outward, thereby defining the inlet opening of the slot.

8. The cable tie as defined in claim 1, wherein the belt is configured to be wrapped around a bundle of tied articles, wherein the belt includes a base portion linearly extending from the buckle and a functional portion having a first linear portion and a second linear portion, wherein the first linear portion is connected to a distal end of the base portion at a proximal end thereof, wherein the second linear portion is connected to a distal end of the first liner portion at a proximal end thereof, wherein the first linear portion is inclined at a first angle with respect to the base portion in a belt wrapping direction, wherein the second linear portion is inclined at a second angle with respect to the first liner portion in the belt wrapping direction, and wherein the first angle is determined to be equal to or smaller than the second angle.

* * * * *